US008139051B2

(12) United States Patent
Ando

(10) Patent No.: US 8,139,051 B2
(45) Date of Patent: Mar. 20, 2012

(54) DRIVER AND DRIVING METHOD, AND DISPLAY DEVICE

(75) Inventor: Naoki Ando, Kanagawa (JP)

(73) Assignee: Sony Corporation, Tokyo (JP)

( * ) Notice: Subject to any disclaimer, the term of this patent is extended or adjusted under 35 U.S.C. 154(b) by 1078 days.

(21) Appl. No.: 12/017,679

(22) Filed: Jan. 22, 2008

(65) Prior Publication Data

US 2008/0180588 A1 Jul. 31, 2008

(30) Foreign Application Priority Data

Jan. 26, 2007 (JP) ..... 2007-016582

(51) Int. Cl.
*G09G 3/36* (2006.01)

(52) U.S. Cl. ..... 345/204; 345/100; 345/209; 345/96

(58) Field of Classification Search ..... 345/204, 345/100, 209, 96
See application file for complete search history.

(56) References Cited

U.S. PATENT DOCUMENTS

2005/0073470 A1* 4/2005 Nose et al. ..... 345/1.1
2006/0256248 A1* 11/2006 Baek et al. ..... 349/42

FOREIGN PATENT DOCUMENTS

JP 2004-226551 8/2004
JP 2005-043661 2/2005
JP 2006-235164 9/2006
JP 2006-308630 11/2006
JP 2006-323044 11/2006
JP 2006-349738 12/2006
JP 2007-333823 12/2007

OTHER PUBLICATIONS

A Japanese Office Action dated Feb. 3, 2009 issued in connection with counterpart Japanese Patent Application No. 2007-016582.

* cited by examiner

*Primary Examiner* — Richard Hjerpe
*Assistant Examiner* — Jeffrey Steinberg
(74) *Attorney, Agent, or Firm* — SNR Denton US LLP

(57) ABSTRACT

The present invention provides a driver, including: data lines disposed in parallel with each other; gate lines disposed in parallel with each other and at right angles to the data lines so as to be electrically insulated from the data lines; odd-numbered pixel cell connected to the odd-numbered data line from the head one, and the odd-numbered gate line from the head one; even-numbered pixel cell connected to the even-numbered data line from the head one, and the even-numbered gate line from the head one; driving means for driving the odd-numbered gate lines and the even-numbered gate lines independently of each other; inputting means for inputting a signal having a predetermined potential to each of the odd-numbered gate lines and the even-numbered gate lines; and comparing means for comparing potentials of the each adjacent odd-numbered data line and even-numbered data line with each other, and outputting a comparison result.

15 Claims, 12 Drawing Sheets

FIG. 4

| | $D_{n-1}$ | $D_n$ | $D_{n+1}$ | $D_{n+2}$ |
|---|---|---|---|---|
| $G_{m'-1}(A)$<br>$G_{m'-1}(B)$ | H | L | H | L |
| $G_{m'}(A)$<br>$G_{m'}(B)$ | L | H | L | H |
| $G_{m'+1}(A)$<br>$G_{m'+1}(B)$ | H | L | H | L |

DRIVER AND DRIVING METHOD, AND DISPLAY DEVICE

CROSS REFERENCES TO RELATED APPLICATIONS

The present invention contains subject matter related to Japanese Patent Application JP 2007-016582 filed in the Japan Patent Office on Jan. 26, 2007, the entire contents of which being incorporated herein by reference.

BACKGROUND OF THE INVENTION

1. Field of the Invention

The present invention relates to a driver and a driving method, and a display device, and more particularly to a driver and a driving method each of which is capable of more precisely detecting a fault caused on a semiconductor substrate or an insulating substrate having pixel cells disposed in matrix therein, and a display device.

2. Description of the Related Art

In recent years, an active matrix system has been widely adopted in liquid crystal display devices such as a liquid crystal projector device and a liquid crystal display device.

FIG. 1 shows an example of a structure of a semiconductor substrate 10 of a liquid crystal display device adopting the active matrix system.

The semiconductor substrate 10 shown in FIG. 1 is provided with a display circuit 11, a data line driving circuit 12, and a gate line driving circuit 13. Note that, a portion about display of a region having nine pixels in total within a screen in which three pixels are horizontally disposed and three pixels are vertically disposed is described with reference to FIG. 1 for the sake of convenience of the description. However, any other portion about display is structured similarly to the case of the portion about display shown in FIG. 1.

The display circuit 11 is structured such that pixel cells 21-1 to 21-9 are disposed in matrix within the screen in which three pixel cells are horizontally disposed, and three pixel cells are vertically disposed. It is noted that when there is no necessity for individually distinguishing the pixel cells 21-1 to 21-9 from one another in the following description, the pixel cells 21-1 to 21-9 are collectively referred to as "the pixel cells 21".

The pixel cells 21 are connected to the data line driving circuit 12 through data lines $D_{n-1}$, $D_n$ and $D_{n+1}$ (n: odd number), respectively, which are disposed in parallel on the semiconductor substrate 10 so as to be insulated from one another. Here, a suffix added to D represents what number the data line concerned belongs to in a direction from a left-hand side to a right-hand side in the figure (in a horizontal direction in the figure).

In addition, the pixel cell 21 is connected to the gate line driving circuit 13 through corresponding one of gate lines $G_{m-1}$, $G_m$ and $G_{m+1}$ (m: odd number) which are disposed in parallel on the semiconductor substrate 10 so as to be electrically insulated from the data lines $D_{n-1}$, $D_n$ and $D_{n+1}$ and so as to make right angles to the data lines $D_{n-1}$, $D_n$ and $D_{n+1}$. Here, a suffix added to G represents what number the data line concerned belongs to in a direction from an upper side to a lower side in the figure (in a vertical direction in the figure).

It is noted that when there is no necessity for individually distinguishing the data lines $D_{n-1}$, $D_n$ and $D_{n+1}$ from one another in the following description, the data lines $D_{n-1}$, $D_n$ and $D_{n+1}$ are collectively referred to as "the data lines D", and also when there is no necessity for individually distinguishing the gate lines $G_{m-1}$, $G_m$ and $G_{m+1}$ from one another in the following description, the gate lines $G_{m-1}$, $G_m$ and $G_{m+1}$ are collectively referred to as "the gate lines G".

The pixel cell 21-1 is composed of a switch 31, an electrode 32, and a capacitor 33. The switch 31, for example, is constituted by a field effect transistor (FET). A gate of the switch 31 is connected to the gate line $G_{m-1}$, and a drain thereof is connected to the data line $D_{n-1}$. In addition, a source of the switch 31 is connected to each of the electrode 32 and one end of the capacitor 33, and the other end of the capacitor 33 is connected to a common electrode.

In the pixel cell 21-1, when the switch 31 is turned ON by drive of the gate line $G_{m-1}$, the charges are accumulated in the capacitor 33 based on a potential of a signal which is inputted to the switch 31 by drive of the data line $D_{n-1}$. That is to say, data is written to the capacitor 33. Also, the switch 31 is turned OFF by stopping the drive of the gate line $G_{m-1}$, so that the capacitor 33 holds therein data thus written thereto.

At this time, a potential $P_{m-1n-1}$ at the electrode 32 is one developed at the one terminal of the capacitor 33 connected to that electrode 32. A liquid crystal held between the semiconductor substrate 10 and a counter substrate (not shown) makes a response to be exited in correspondence to a difference between the potential $P_{m-1n-1}$ and a potential of the counter substrate. Here, the counter substrate is a semiconductor substrate which is disposed so as to face the semiconductor substrate 10, and which has the common electrode. As a result, the pixel corresponding to the pixel cell 21-1 is activated for display. It is noted that while a description is omitted here for the sake of simplicity, each of the pixel cells 21 other than the pixel cell 21-1 is structured similarly to the case of the pixel cell 21-1 and similarly operates.

The data line driving circuit 12, for example, is provided with a shift register and the like. The data line driving circuit 12 successively shifts data which is inputted thereto from the outside every horizontal line to scan the data lines D in the horizontal direction, thereby successively driving the data lines D.

The gate line driving circuit 13, for example, is provided with a shift register and the like. The gate line driving circuit 13 successively shifts data which is inputted thereto for control for the scanning from the outside, thereby successively driving the gate lines $G_{m-1}$, $G_m$ and $G_{m+1}$ every period of time for the horizontal scanning. As a result, the switches 31 of the pixel cells 21 are turned ON in order in units of the switches 31 of the pixel cells 21 disposed in the horizontal direction, so that a horizontal line as a scanning object moves vertically.

The data line driving circuit 12 and the gate line driving circuit 13 carry out the drive in the manner as described above, which results in that the data is successively written to the capacitors 33 of the pixel cells 21 to excite the liquid crystal, thereby displaying a desired image on the screen.

Now, in such a semiconductor substrate, a line fault such as short circuit or disconnection may be caused in manufacturing processes. For this reason, it is inspected whether or not the line fault is caused on the semiconductor substrate in the manufacturing processes.

FIG. 2 shows an example of a structure of a semiconductor substrate 40 which is provided with a detection circuit for detecting a fault for the inspection. It is noted that the same constituent elements as those shown in FIG. 1 are designated with the same reference numerals, respectively, and a repeated description thereof is omitted here for the sake of simplicity.

In the semiconductor substrate 40, a detection circuit 41 is provided across the display circuit 11 from the data line driving circuit 12.

The detection circuit 41 detects the line fault caused on the semiconductor substrate 40 by utilizing a predetermined detecting method. The following detecting method, for example, is known in the art as this detecting method. That is to say, an AND gate is provided as a detection circuit, and a signal having a predetermined potential is applied across adjacent two data lines or gate lines. Also, the line fault caused on the semiconductor substrate 40 is detected based on a logical product of logical values corresponding to potentials of the adjacent two data lines or gate lines after application of the signal having the predetermined potential across them. This detecting method, for example, is described in Japanese Patent Laid-Open No. 2005-43661.

In addition, another detecting method is known in the art as follows. That is to say, the line fault caused on the semiconductor substrate 40 is detected based on a change in potential before and after an operation for reading out charges accumulated in the capacitor 33 in a phase of write of data to the data line D which has an arbitrary voltage applied thereto, and which is set in a high impedance state.

However, the recent liquid crystal display devices for which a high definition is advanced involve the following problem. That is to say, a ratio of a capacity of the capacitor 33 to a parasitic capacity of the data line is equal to or larger than 1:200. Also, the potential change before and after the reading-out operation is minute. As a result, the detection results are readily influenced by noises.

In order to cope with this problem, there is also devised a detecting method of detecting a line fault caused on a semiconductor substrate based on a comparison of potential changes, before and after an reading-out operation, appearing across adjacent two data lines or gate lines.

SUMMARY OF THE INVENTION

However, with this detecting method, the line fault in one of the data lines or gate lines may not be detected in some cases because the comparison results become identical to those when no line fault is caused.

The present invention has been made in the light of such circumstances, and it is therefore desirable to provide a driver and a driving method each of which is capable of more precisely detecting a fault caused on a semiconductor substrate or an insulating substrate having pixel cells disposed in matrix therein.

According to an embodiment of the present invention, there is provided a driver, including: at least two data lines disposed in parallel with each other; at least two gate lines disposed in parallel with each other and at right angles to the at least two data lines so as to be electrically insulated from the at least two data lines; odd-numbered pixel cells as at least one pixel cell connected to the odd-numbered data lines from the head one, and the odd-numbered gate lines from the head one; even-numbered pixel cells as at least one pixel cell connected to the even-numbered data lines from the head one, and the even-numbered gate lines from the head one. The driver further includes: driving means for driving the odd-numbered gate lines and the even-numbered gate lines independently of each other; inputting means for inputting a signal having a predetermined potential to each of the odd-numbered gate lines and the even-numbered gate lines; and comparing means for comparing potentials of the each adjacent odd-numbered data line and even-numbered data line with each other, and outputting a comparison result. The odd-numbered pixel cells and the even-numbered pixel cells are disposed in matrix; each of the odd-numbered pixel cells and the even-numbered pixel cells includes accumulating means for accumulating therein charges based on a potential of a signal corresponding to pixel data inputted through corresponding one of the data lines connected thereto, and connecting means for connecting the corresponding one of the data lines connected thereto and the accumulating section to each other based on a potential of corresponding one of the data lines connected thereto. The driver further includes: the at least two data lines, the at least two gate lines, the odd-numbered pixel cells, the even-numbered pixel cells, the driving means, the inputting means, and the comparing means are disposed either on a semiconductor substrate or on an insulating substrate.

According to the embodiment of the present invention, the driver includes the at least two data lines disposed in parallel with each other, the at least two gate lines disposed in parallel with each other and at right angles to the at least two data lines so as to be electrically insulated from the at least two data lines, the odd-numbered pixel cells as at least one pixel cell connected to the odd-numbered data lines from the head one and the odd-numbered gate lines from the head one, and the even-number pixel cells as at least one pixel cell connected to the even-numbered data lines from the head one and the even-numbered gate lines from the head one. In addition, the odd-numbered gate lines and the even-numbered gate lines are driven independently of each other. The signal having the predetermined potential is inputted to each of the odd-numbered data lines and the even-numbered data lines. Also, the potentials of the each adjacent odd-numbered data line and even-numbered data line are compared with each other, and the comparison result is outputted.

According to another embodiment of the present invention, there is provided a driving method for a driver in which at least two data lines disposed in parallel with each other, at least two gate lines disposed in parallel with each other and at right angles to the at least two data lines so as to be electrically insulated from the at least two data lines, odd-numbered pixel cells as at least one pixel cell connected to the odd-numbered data lines from the head one and the odd-numbered gate lines from the head one, and even-numbered pixel cells as at least one pixel cell connected to the even-numbered data lines from the head one and the even-numbered gate lines from the head one are provided either on a semiconductor substrate or on an insulating substrate, the odd-numbered pixel cells and the even-numbered pixel cells being disposed in matrix. The driving method includes the steps of: driving the odd-numbered gate lines and the even-numbered gate lines adjacent thereto; accumulating charges in each of the odd-numbered pixel cells based on a first potential of each of the odd-numbered data lines, and accumulating charges in each of the even-numbered pixel cells based on a second potential of each of the even-numbered data lines in accordance with the drive; stopping the drive for the odd-numbered gate lines and the even-numbered gate lines adjacent thereto; stopping the accumulation of the charges in each of the odd-numbered pixel cells and the even-numbered pixel cells in accordance with the stop of the drive to hold the charges in each of the odd-numbered pixel cells and the even-numbered pixel cells. The driving method further includes the steps of: setting a potential of each of the odd-numbered data lines and the even-numbered data lines adjacent thereto at a predetermined potential; setting each of the odd-numbered data lines and the even-numbered data lines adjacent thereto in a high impedance state; driving ones of the odd-numbered gate lines and the even-numbered gate lines adjacent thereto as a drive object; outputting the charges accumulated in the odd-numbered pixel cells or the even-numbered pixel cells connected to the drive object to the odd-numbered data lines or the even-numbered data lines in accordance with the drive; comparing potentials of the each adjacent odd-numbered data line and even-numbered data line with each other; and executing one side processing as processing.

According to the another embodiment of the present invention, in the driving method for the driver, there are driven the odd-numbered gate lines from the head one of the at least two gate lines disposed in parallel with each other and at right angles to the at least two data lines so as to be electrically insulated from the at least two data lines disposed in parallel with each other, and the even-numbered gate lines from the head one adjacent thereto. In addition, the charges are accumulated in each of the odd-numbered pixel cells as the at least one pixel cell connected to the odd-numbered data lines from the head one and the odd-numbered gate lines from the head one based on the first potential of each of the odd-numbered data lines from the head one in accordance with that drive. Also, the charges are accumulated in each of the even-numbered pixel cells as the a least one pixel cell connected to the even-numbered data lines from the head one and the even-numbered gate lines from the head one based on the second potential of each of the even-numbered data lines from the head one in accordance with that drive. Also, the drive for the odd-numbered gate lines and the even-numbered gate lines adjacent thereto is stopped. The accumulation of the charges in each of the odd-numbered pixel cells and the even-numbered pixel cells in accordance with that drive to hold the charges in each of the odd-numbered pixel cells and the even-numbered pixel cells. The potential of each of the odd-numbered data lines and the even-numbered data lines is set at the predetermined potential. Each of the odd-numbered data lines and the even-numbered data lines is set in the high impedance state. Ones of the odd-numbered gate lines and the even-numbered gate lines adjacent thereto are driven as the drive object. The charges accumulated in the odd-numbered pixel cells or the even-numbered pixel cells connected to the drive object are outputted to the odd-numbered data lines or the even-numbered data lines in accordance with that drive. Also, the potentials of the each adjacent odd-numbered data lines and even-numbered data lines are compared with one another.

According to still another embodiment of the present invention, there is provided a liquid crystal display device, including: a first substrate as a semiconductor substrate or an insulating substrate; a second substrate, as a semiconductor substrate or an insulating substrate having a common electrode, disposed so as to face the first substrate; and a liquid crystal layer held between the first substrate and the second substrate. And the first substrate includes at least two data lines disposed in parallel with each other, at least two gate lines disposed in parallel with each other and at right angles to the at least two data lines so as to be electrically insulated from the at least two data lines, odd-numbered pixel cells as at least one pixel cell connected to the odd-numbered data lines from the head one, and the odd-numbered gate lines from the head one, even-numbered pixel cells as at least one pixel cell connected to the even-numbered data lines from the head one, and the even-numbered gate lines from the head one. The first substrate further includes driving means for driving the odd-numbered gate lines and the even-numbered gate lines independently of each other, inputting means for inputting a signal having a predetermined potential to each of the odd-numbered data lines and the even-numbered data lines, and comparing means for comparing potentials of the each adjacent odd-numbered data line and even-numbered data line with each other, and outputting a comparison result. The odd-numbered pixel cells and the even-numbered pixel cells are disposed in matrix; and each of the odd-numbered pixel cells and the even-numbered pixel cells includes accumulating means for accumulating therein charges based on a potential of a signal corresponding to image data inputted through corresponding one of the data lines connected thereto, and connecting means for connecting the corresponding one of the data lines connected thereto and the accumulating section to each other based on a potential of corresponding one of the gate lines connected thereto.

According to the still another embodiment of the present invention, in the liquid crystal display device, the liquid crystal layer is held between the first substrate as the semiconductor substrate or the insulating substrate, and the second substrate, as the semiconductor substrate or the insulating substrate having the common electrode, disposed so as to face the first substrate. Note that, the first substrate includes the at least two data lines disposed in parallel with each other, the at least two gate lines disposed in parallel with each other ant at right angles to the at least two data lines so as to be electrically insulating from the at least two gate lines, the odd-numbered pixel cells as the at least one pixel cell connected to the odd-numbered data lines from the head one and the odd-numbered gate lines from the head one, the even-numbered pixel cells as the at least one pixel cell connected to the even-numbered data lines from the head one and the even-numbered gate lines from the head one, the driving means for the odd-numbered gate lines and the even-numbered gate lines independently of each other, the inputting means for inputting the signal having the predetermined potential to each of the odd-numbered data lines and the even-numbered data line, and the comparing means for comparing the potentials of the each adjacent odd-numbered data line and even-numbered data line, and outputting the comparison result. Also, the odd-numbered pixel cells and the even-numbered pixel cells are disposed in matrix.

As set forth hereinabove, according to the embodiments of the present invention, a fault caused on the semiconductor substrate or the insulating substrate having the pixel cells disposed in matrix therein can be more precisely detected.

BRIEF DESCRIPTION OF THE DRAWINGS

FIG. 4 is a table showing an example of potentials of signals inputted to data lines, respectively;

DETAILED DESCRIPTION OF THE PREFERRED EMBODIMENTS

Although embodiments of the present invention will be described in detail hereinafter, a relationship of correspondence between the constitutional requirements of the present invention, and the embodiments described in the specification or the drawings is exemplified as follows. This description is given in order to confirm that the embodiments supporting the present invention are described in the specification or the drawings. Therefore, even when although being described in the specification or the drawings, the embodiment not described here exists as the embodiment corresponding to the constitutional requirements of the present invention, this does not mean that that embodiment does not correspond to the constitutional requirements of the present invention. Conversely, even when the embodiment is described here as one corresponding to the constitutional requirements, this does not mean that that embodiment does not correspond to the constitutional requirements other than those constitutional requirements.

Figure 1:
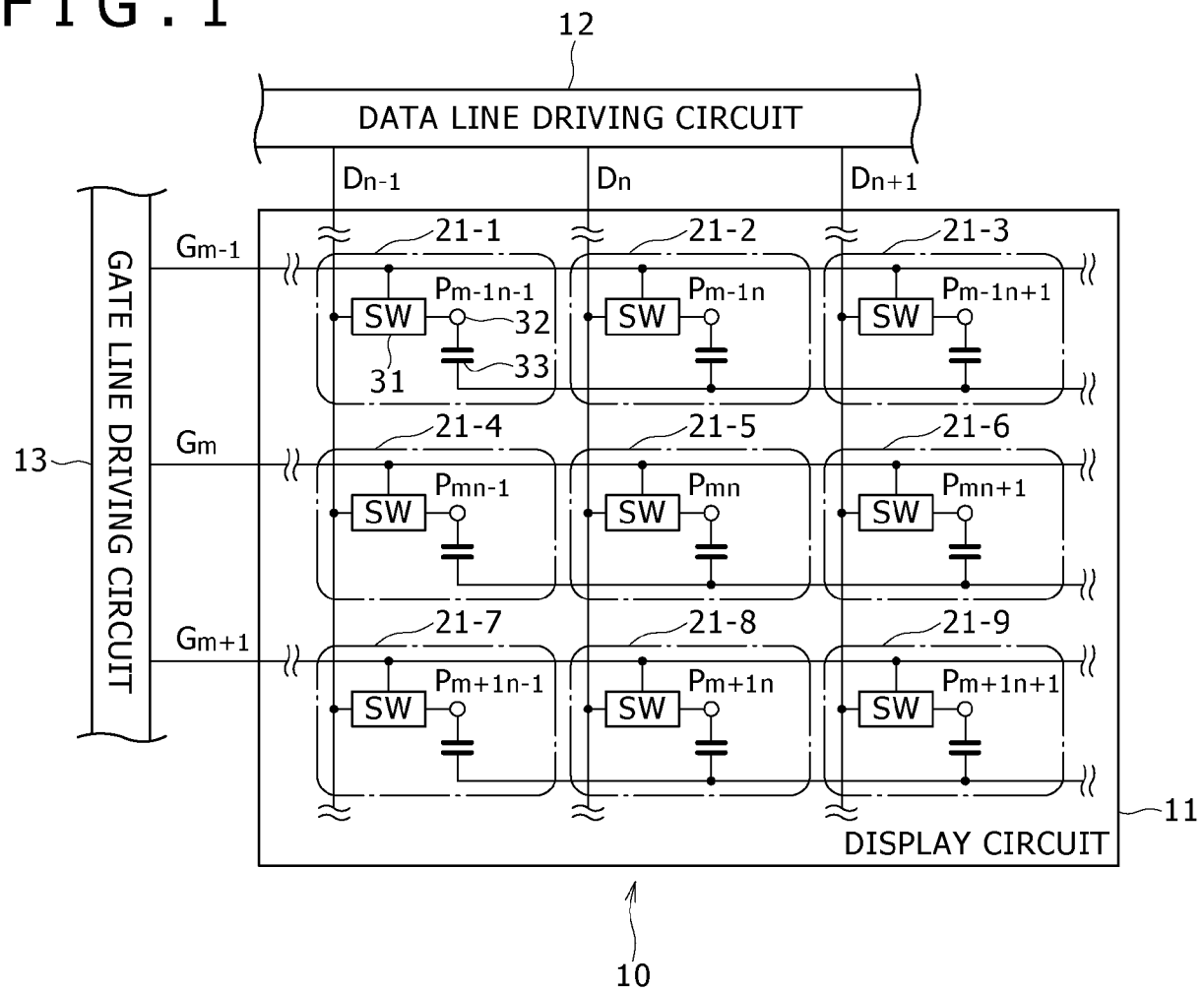
FIG. 1 is a schematic circuit diagram showing an example of a structure of a semiconductor substrate of a liquid crystal display device adopting an active matrix system.
Figure 2:
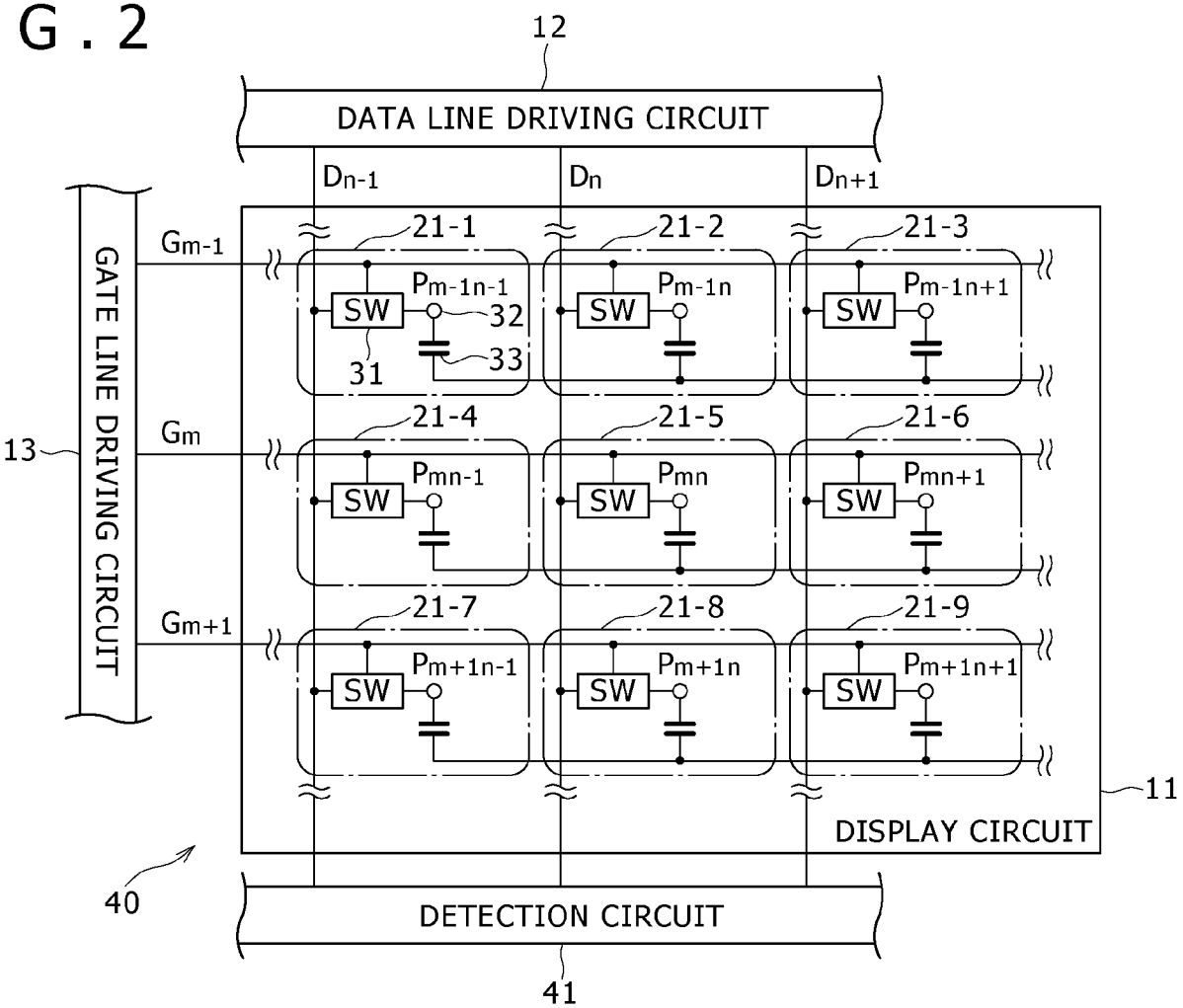
FIG. 2 is a schematic circuit diagram showing an example of a structure of a semiconductor substrate including a detection circuit for detecting a fault caused on the semiconductor substrate.
Figure 3:
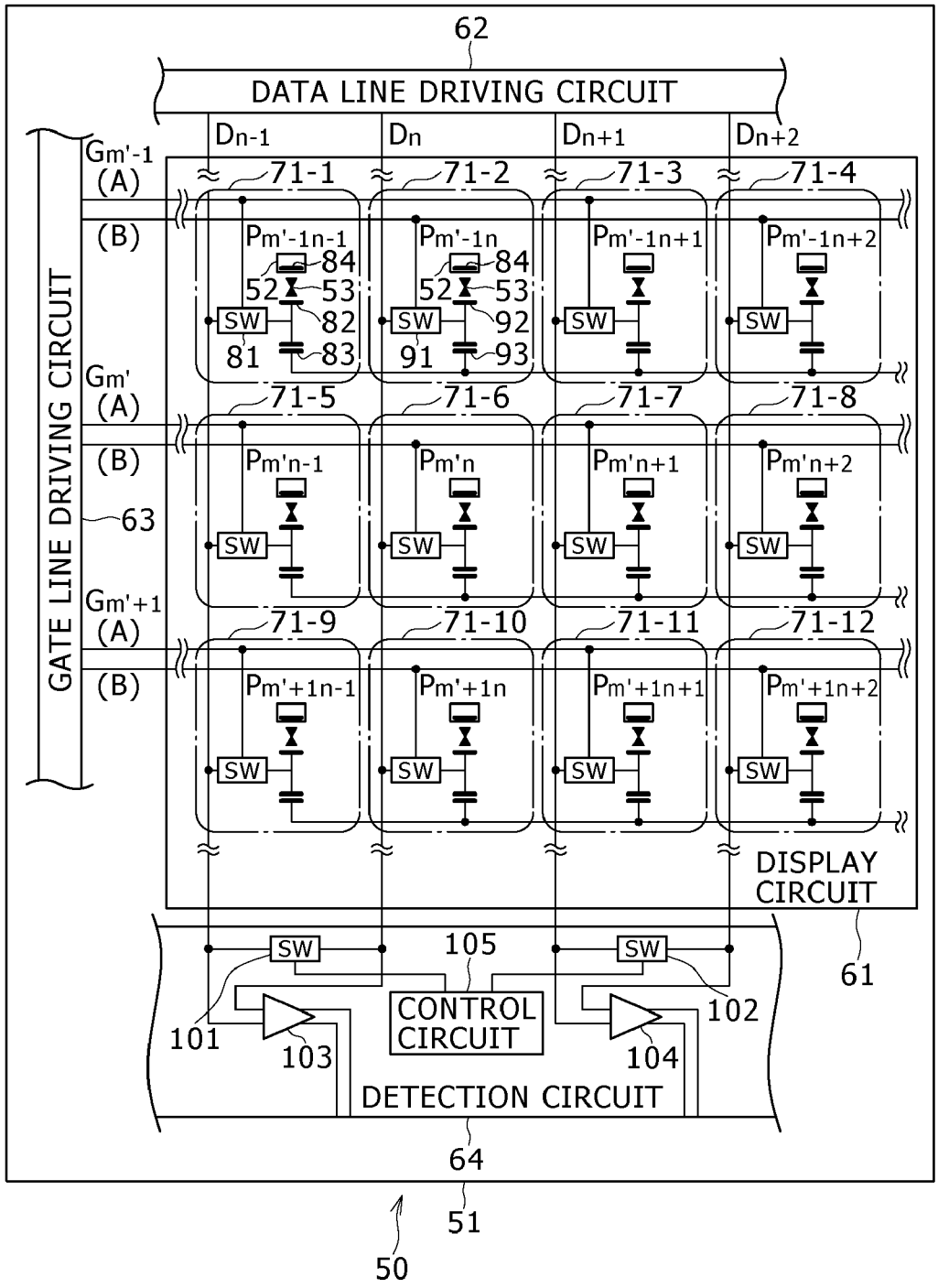
FIG. 3 is a schematic circuit diagram showing a structure of a liquid crystal display device according to a first embodiment of the present invention.

A driver (for example, a liquid crystal display device 50 of FIG. 3) according to a first embodiment mode of the present invention includes:

at least two data lines (for example, a data line $D_{n-1}$ of FIG. 3) disposed in parallel with each other;

at least two gate lines (for example, a gate line $G_{m'-1}(A)$ of FIG. 3) disposed in parallel with each other and at right angles to the at least two data lines so as to be electrically insulated from the at least two data lines;

odd-numbered pixel cells (for example, a pixel cell 71-1 of FIG. 3) as at least one pixel cell connected to the odd-numbered data lines (for example, a data line $D_{n-1}$ of FIG. 3) from the head one and the odd-numbered gate lines (for example, a gate line $G_{m'-1}(A)$ of FIG. 3) from the head one;

even-numbered pixel cells (for example, a pixel cell 71-2 of FIG. 3) as at least one pixel cell connected to the even-numbered data lines (for example, a data line $D_n$ of FIG. 3) from the head one, and the even-numbered gate lines (for example, a gate line $G_{m'-1}(B)$ of FIG. 3) from the head one;

driving means (for example, a gate line driving circuit 63 of FIG. 3) for driving the odd-numbered gate lines and the even-numbered gate lines independently of each other;

inputting means (for example, a switch 101 of FIG. 3) for inputting a signal having a predetermined potential to each of the odd-numbered data lines and the even-numbered data lines; and comparing means (for example, a comparator 103 of FIG. 3) for comparing potentials of the each adjacent odd-numbered data lines and even-numbered data line with each other, and outputting a comparison result;

in which the odd-numbered pixel cells and the even-numbered pixel cells are disposed in matrix;

each of the odd-numbered pixel cells and the even-numbered pixel cells includes accumulating means (for example, a capacitor 83 of FIG. 3) for accumulating therein charges based on a potential of a signal corresponding to pixel data inputted through corresponding one of the data lines connected thereto, and connecting means (for example, a switch 81 of FIG. 3) for connecting corresponding one of the data lines connected thereto and the accumulating means to each other based on a potential of corresponding one of the gate lines connected thereto, and the at least two data lines, the at least two gate lines, the odd-numbered pixel cells, the even-numbered pixel cells, the driving means, the inputting means, and the comparing means are disposed on a semiconductor substrate or an insulating substrate (for example, a substrate 51 of FIG. 3).

The driver according to the first embodiment mode of the present invention further includes control means (for example, a control circuit 105 of FIG. 3) for inputting a control signal in accordance with which the inputting means is controlled to the inputting means, and the inputting means connects the each adjacent odd-numbered data line and even-numbered data line to each other in accordance with the control signal, thereby causing the potentials of the each adjacent odd-numbered data line and even-numbered data line to be an average value of the each adjacent odd-numbered data line and even-numbered data line.

The driver according to the first embodiment mode of the present invention further includes control means (for example, a control circuit 105 of FIG. 11) for inputting a control signal in accordance with which the inputting means is controlled to the inputting means; and the inputting means includes odd-numbered inputting means (for example, a switch 211 of FIG. 11) for inputting the signal having the predetermined potential to each of the odd-numbered data lines in accordance with the control signal, and even-numbered inputting means (for example, a switch 212 of FIG. 11) for inputting the signal having the predetermined potential to each of the even-numbered data lines in accordance with the control signal.

Figure 8:
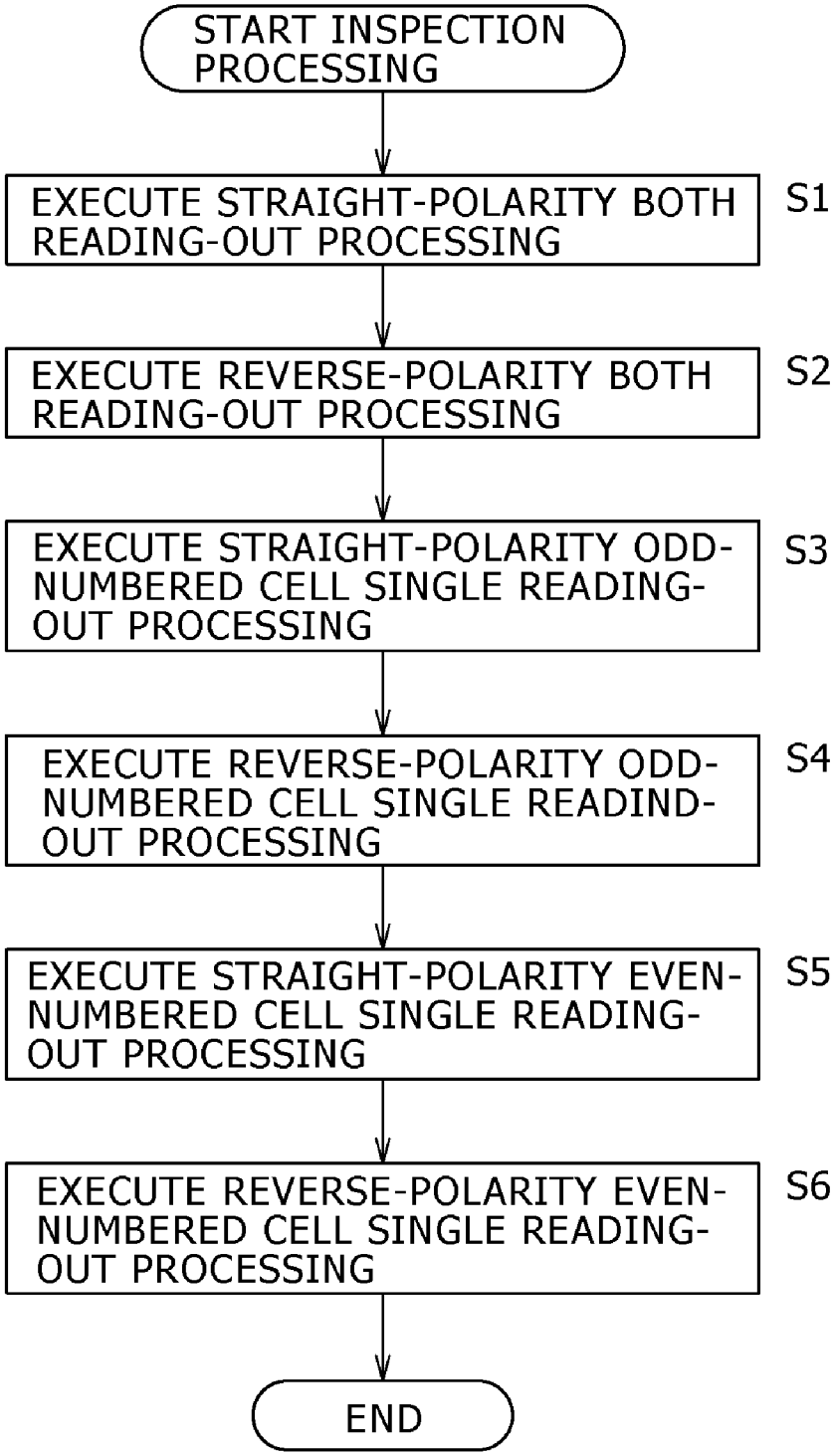
FIG. 8 is a flow chart explaining inspection processing.
Figure 10:
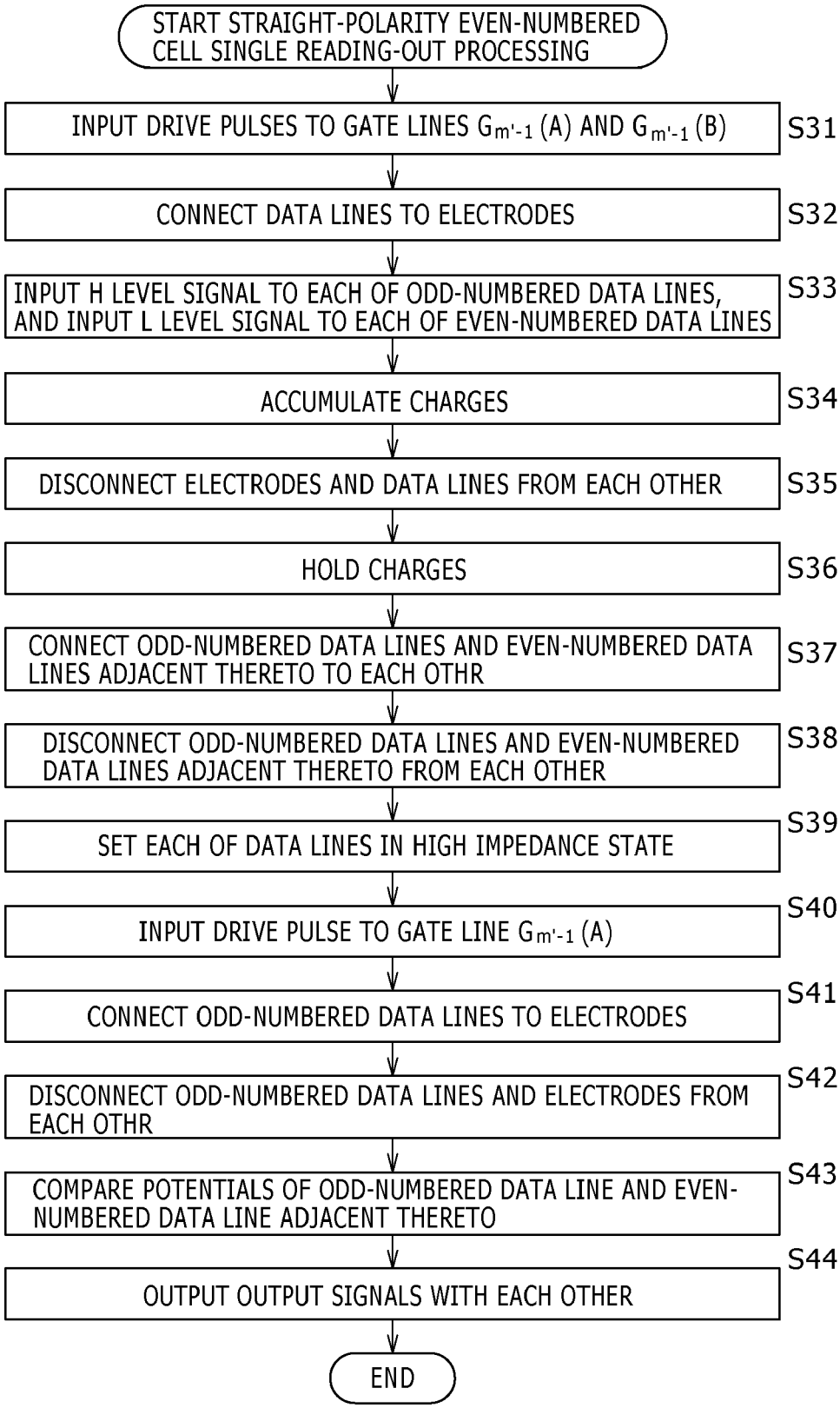
FIG. 10 is a flow chart explaining details of straight-polarity odd-numbered cell single reading-out processing shown in FIG. 8.

A driving method according to a second embodiment mode of the present invention is one for a driver (for example, a liquid crystal display device 50 of FIG. 3) in which at least two data lines (for example, a data line $D_{n-1}$ of FIG. 3) disposed in parallel with each other, at least two gate lines (for example, a gate line $G_{m'-1}(A)$ of FIG. 3) disposed in parallel with each other and at right angles to the at least two data lines so as to be electrically insulated from the at least two data lines, odd-numbered pixel cells (for example, a pixel cell 71-1 of FIG. 3) as at least one pixel cell connected to the odd-numbered data lines (for example, a data line $D_{n-1}$ of FIG. 3) from the head one and the odd-numbered gate lines (for example, a gate line $G_{m'-1}(A)$ of FIG. 3) from the head one, and even-numbered pixel cells (for example, a pixel cell 71-2 of FIG. 3) as at least one pixel cell connected to the even-numbered data lines (for example, a data line $D_n$ of FIG. 3) from the head one and the even-numbered gate lines (for example, a gate line $G_{m'-1}(B)$ of FIG. 3) from the head one are provided on a semiconductor substrate or an insulating substrate (for example, a substrate 51), the odd-numbered pixel cells and the even-numbered pixel cells being disposed in matrix. In this case, the driving method for a driver according to the second embodiment mode of the present invention includes the steps of:

driving the odd-numbered gate lines and the even-numbered gate lines adjacent thereto (for example, Step S31 of FIG. 10);

accumulating charges in each of the odd-numbered pixel cells based on a first potential of each of the odd-numbered data lines, and accumulating charges in each of the even-numbered pixel cells based on a second potential of each of the even-numbered data lines in accordance with that drive (for example, Step S34 of FIG. 10);

stopping the drive for the odd-numbered gate lines and the even-numbered gate lines adjacent thereto (for example, Step S35 of FIG. 10);

stopping the accumulation of the charges in each of the odd-numbered pixel cells and the even-numbered pixel cells in accordance with the stop of that drive to hold the charges in each of the odd-numbered pixel cells and the even-numbered pixel cells (for example, Step S36 of FIG. 10);

setting a potential of each of the odd-numbered data lines and the even-numbered data lines at a predetermined potential (for example, Step S37 of FIG. 10);

setting each of the odd-numbered data lines and the even-numbered data lines in a high impedance state (for example, Step S39 of FIG. 10);

driving ones of the odd-numbered gate lines and the even-numbered gate lines adjacent thereto as a drive object (for example, Step S40 of FIG. 10);

outputting the charges accumulated in the odd-numbered pixel cells or the even-numbered pixel cells connected to that drive object to the odd-numbered data lines or the even-numbered data lines in accordance with that drive (for example, Step S41 of FIG. 10);

comparing potentials of the each adjacent odd-numbered data line and even-numbered data line with each other (for example, Step S43 of FIG. 10); and executing one processing (for example, straight-polarity odd-numbered cell single reading-out processing) as processing (for example, Step S3 of FIG. 8).

The driving method according to the second embodiment mode of the present invention further includes the step of executing one changing processing (for example, reverse-polarity odd-number cell single reading-out processing) as processing for changing the potential of each of the odd-numbered data lines from the first potential to the second potential, and changing the potential of each of the even-numbered data lines from the second potential to the first potential in the one side processing (for example, Step S4 of FIG. 8).

The driving method according to the second embodiment mode of the present invention further includes the step of executing the other processing (for example, straight-polarity even-numbered cell single reading-out processing) as processing for changing the drive object from ones of the odd-numbered gate lines and the even-numbered gate lines adjacent thereto to the others thereof in the one processing (for example, Step S5 of FIG. 8).

In the driving method according to the second embodiment mode of the present invention, the first potential and the second potential are different in polarity from each other with respect to the predetermined potential. In this case, the driving method according to the second embodiment mode of the present invention further includes the step of executing the other changing processing (for example, reverse-polarity even-numbered cell single reading-out processing) as processing for changing the potential of each of the odd-numbered data lines from the first potential to the second potential, and changing the potential of each of the even-numbered data lines from the second potential to the first potential (for example, Step S6 of FIG. 8).

The driving method according to the second embodiment mode of the present invention further includes the step of executing both processing (for example, straight-polarity both reading-out processing) as processing for changing the drive object from ones of the odd-numbered gate lines and the even-numbered gate lines adjacent thereto to both of the odd-numbered gate lines and the even-numbered gate lines adjacent thereto in the one processing (for example, Step S1 of FIG. 8).

In the driving method according to the second embodiment mode of the present invention, the first potential and the second potential are different in polarity from each other with respect to the predetermined potential. In this case, the driving method according to the second embodiment mode of the present invention further includes the step of executing both changing processing (for example, reverse-polarity both reading-out processing) as processing for changing the potential of each of the odd-numbered data lines from the first potential to the second potential, and changing the potential of each of the even-numbered data lines from the second potential to the first potential in the both processing (for example, Step S2 of FIG. 8).

A liquid crystal display device according to a third embodiment mode of the present invention includes:

a first substrate (for example, a substrate 51 of FIG. 3) as a semiconductor substrate or an insulating substrate;

a second substrate (for example, a counter substrate 52 of FIG. 3), as a semiconductor substrate or an insulating substrate having a common electrode, disposed so as to face the first substrate; and a liquid crystal layer (for example, a liquid crystal layer 53 of FIG. 3) held between the first substrate and the second substrate;

in which the first substrate includes at least two data lines (for example, the data line $D_{n-1}$ of FIG. 3) disposed in parallel with each other, at least two gate lines (for example, the gate line $G_{m'-1}(A)$ of FIG. 3) disposed in parallel with each other and at right angles to the at least two data lines so as to be electrically insulated from the at least two data lines, odd-numbered pixel cells (for example, the pixel cell 71-1 of FIG. 3) as at least one pixel cell connected to the odd-numbered data lines (for example, a data line $D_{n-1}$ of FIG. 3) from the head one and the odd-numbered gate lines (for example, the gate line $G_{m'-1}(A)$ of FIG. 3) from the head one, even-numbered pixel cells (for example, the pixel cell 71-2 of FIG. 3) as at least one pixel cell connected to the even-numbered data lines (for example, a data line $D_n$ of FIG. 3) from the head one, and the even-numbered gate lines (for example, the gate line $G_{m'-1}(B)$ of FIG. 3) from the head one, driving means (for example, a gate line driving circuit 63 of FIG. 3) for driving the odd-numbered gate lines and the even-numbered gate lines independently of each other, inputting means (for example, the switch 101 of FIG. 3) for inputting a signal having a predetermined potential to each of the odd-numbered data lines and the even-numbered data lines, and comparing means (for example, the comparator 103 of FIG. 3) for comparing potentials of the each adjacent odd-numbered data lines and even-numbered data line with each other, and outputting a comparison result, in which the odd-numbered pixel cells and the even-numbered pixel cells are disposed in matrix; and each of the odd-numbered pixel cells and the even-numbered pixel cells includes accumulating means (for example, the capacitor 83 of FIG. 3) for accumulating therein charges based on a potential of a signal corresponding to pixel data inputted through corresponding one of the data lines connected thereto, and connecting means (for example, the switch 81 of FIG. 3) for connecting corresponding one of the data lines connected thereto and the accumulating means to each other based on a potential of corresponding one of the gate lines connected thereto.

Preferred embodiments of the present invention will be described in detail hereinafter with reference to the accompanying drawings.

FIG. 3 is a schematic circuit diagram showing a structure of a liquid crystal display device according to a first embodiment of the present invention.

A liquid crystal display device 50 shown in FIG. 3 is composed of a substrate 51 as a semiconductor substrate or an insulating substrate, a counter substrate 52, as a semiconductor substrate or an insulating substrate, disposed so as to face the substrate 51, and a liquid crystal layer 53 held between the substrate 51 and the counter substrate 52.

A display circuit 61, a data line driving circuit 62, a gate line driving circuit 63, and a detection circuit 64 are disposed on the substrate 51. It is noted that although a portion about display of a region having twelve pixels in total within a screen in which four pixels are horizontally disposed and three pixels are vertically disposed is described below with reference to FIG. 3 for the sake of convenience of a description, any other portion about display is structured similarly to the case of the portion about display shown in FIG. 3.

The display circuit 61 is formed such that a plurality of pixel cells 71-1 to 71-12 are disposed in matrix so that four pixel cells are horizontally disposed and three pixel cells are vertically disposed. It is noted that when there is no necessity for individually distinguishing the plurality of pixel cells 71-1 to 71-12 from one another in the following description, they are collectively referred to as "the pixel cells 71".

The pixel cells 71 are connected to the data line driving circuit 62 through data lines $D_{n-1}$, $D_n$, $D_{n+1}$, and $D_{n+2}$, respectively, which are disposed in parallel with each other on the substrate 51 so as to be insulated from one another. In addition, the pixel cells 71 are connected to the gate line driving circuit 63 through gate lines $G_{m'-1}(A)$, $G_{m'-1}$ (B), $G_{m'}(A)$, $G_{m'}(B)$, and $G_{m'+1}(A)$ and $G_{m'+1}$ (B) (m': odd number), respectively. Here, the gate lines $G_{m'-1}(A)$, $G_{m'-1}(B)$, $G_{m'}(A)$, $G_{m'}(B)$, and $G_{m'+1}(A)$ and $G_{m'+1}(B)$ are disposed in parallel with one another and at right angles to the data lines $D_{n-1}$, $D_n$, $D_{n+1}$, and $D_{n+2}$ so as to be electrically insulated from the data lines $D_{n-1}$, D, $D_{n+1}$, and $D_{n+2}$.

Here, a suffix added to G represents what number the gate lines, disposed in units of two lines, including the gate line concerned belong to in a direction from an upper side to a lower side in the figure (in a vertical direction in the figure). In addition, (A) added to G represents that the gate line concerned is the odd-numbered gate line in the direction from the upper side to the lower side in the figure. On the other hand, (B) added to G represents that the gate line concerned is the even-numbered gate line in the direction from the upper side to the lower side in the figure. It is noted that when there is no necessity for individually distinguishing the gate lines $G_{m'-1}$ (A), $G_{m'}(A)$, and $G_{m'+1}(A)$ from one another in the following description, they are collectively referred to as "the gate lines G(A)". In addition, it is noted that when there is no necessity for individually distinguishing the gate lines $G_{m'-1}(B)$, $G_{m'}$ (B), and $G_{m'+1}(B)$ from one another in the following description, they are collectively referred to as "the gate lines G(B)".

The pixel cell 71-1 is composed of a switch 81, an electrode 82, and a capacitor 83. The switch 81, for example, is constituted by an FET. A gate of the switch 81 is connected to the odd-numbered gate line $G_{m'-1}(A)$ from the upper side, and a drain thereof is connected to the odd-numbered data line $D_{n-1}$ from the left-hand side. In addition, a source of the switch 81 is connected to each of the electrode 82 and one end of the capacitor 83, and the other end of the capacitor 83 is connected to the common electrode.

In the pixel cell 71-1, when the switch 81 is turned ON by drive of the gate line $G_{m'-1}(A)$, the charges are accumulated in the capacitor 83 based on a voltage of a signal which is inputted to the switch 81 by drive of the data line $D_{n-1}$. That is to say, data is written to the capacitor 83. Also, the switch 81 is turned OFF by stopping the drive of the gate line $G_{m'-1}(A)$, so that the capacitor 83 holds therein the data written thereto.

At this time, a potential $P_{m'-1n-1}$ at the electrode 82 is one developed at the one end of the capacitor 83 connected to the electrode 82. The liquid crystal layer 53 is activated to be excited in correspondence to a difference between the potential $P_{m'-1n-1}$ at the electrode 82 and a potential at the common electrode 84 which the counter substrate 52 has. As a result, the pixel corresponding to the pixel cell 71-1 is activated for display. Note that, while a description is omitted here for the sake of simplicity, each of the pixel cells 71-5 and 71-9 disposed in the same position in vertical direction as that of the pixel cell 71-1, and the pixel cells 71-3, 71-7 and 71-11 disposed on the right-hand side next but one thereto is structured similarly to the case of the pixel cell 71-1, and performs the same operation as that of the pixel cell 71-1.

In addition, the pixel cell 71-2 is composed of a switch 91, an electrode 92, and a capacitor 93. The switch 91, for example, is constituted by the FET. A gate of the switch 91 is connected to the even-numbered gate line $G_{m'-1}(B)$ from the upper side, and a drain thereof is connected to the even-numbered data line $D_n$ from the left-hand side. In addition, a source of the switch 91 is connected to each of the electrode 92 and one end of the capacitor 93, and the other end of the capacitor 93 is connected to the common electrode.

In the pixel cell 71-2, when the switch 91 is turned ON by drive of the gate line $G_{m'-1}(B)$, the charges are accumulated in the capacitor 93 based on a voltage of a signal which is inputted to the switch 91 by drive of the data line $D_n$. That is to say, data is written to the capacitor 93. Also, the switch 91 is turned OFF by stopping the drive of the gate line $G_{m'-1}(B)$, so that the capacitor 93 holds therein the data written thereto.

At this time, a potential $P_{m'-1n}$ at the electrode 92 is one developed at the one end of the capacitor 93 connected to the electrode 92. The liquid crystal layer 53 is activated to be excited in correspondence to a difference between the potential $P_{m'-1n}$ at the electrode 92 and a potential at the common electrode 84 which the counter substrate 52 has. As a result, the pixel corresponding to the pixel cell 71-2 is activated for display. Note that, while a description is omitted here for the sake of simplicity, each of the pixel cells 71-6 and 71-10 disposed in the same position in vertical direction as that of the pixel cell 71-2, and the pixel cells 71-4, 71-8 and 71-12 disposed on the right-hand side next but one thereto is structured similarly to the case of the pixel cell 71-2, and performs the same operation as that of the pixel cell 71-2.

As has been described above, the pixel cells 71-1, 71-5 and 71-9, and 71-3, 71-7 and 71-11 which are connected to the odd-numbered data lines $D_{n-1}$ and $D_{n+1}$ from the left-hand side, respectively, are also connected to the odd-numbered gate lines $G_{m'-1}(A)$, $G_{m'}(A)$ and $G_{m'+1}(A)$ from the upper side. On the other hand, the pixel cells 71-2, 72-6 and 71-10, and 71-4, 72-8 and 71-12 which are connected to the even-numbered data lines $D_n$ and $D_{n+2}$ from the left-hand side, respectively, are also connected to the even-numbered gate lines $G_{m'-1}(B)$, $G_{m'}(B)$ and $G_{m'+1}(B)$ from the upper side.

The data line driving circuit 62, for example, is provided with a shift register and the like. The data line driving circuit 62 successively shifts the data which is inputted thereto every horizontal line from the outside, thereby successively driving the data lines D so that the data lines D is successively scanned in the horizontal direction. Here, the drive for the data lines D means that a signal having a potential corresponding to data inputted from the outside is successively inputted to the data lines D. In addition, the data line driving circuit 62 successively shifts data which is inputted from the outside and which is used to inspect a fault caused on the substrate 51, thereby successively driving the data lines D.

The gate line driving circuit 63, for example, is provided with a shift register and the like, and controls the gate lines G(A) and G(B) independently of each other. The gate line driving circuit 63 successively shifts data which is inputted thereto from the outside and which is used to control the scanning, thereby successively driving the gate lines G(A) and G(B) in units of two lines every period of time for the horizontal scanning. As a result, the switches 81(91) of the pixel cells 71 are successively turned ON in units of the switches 81(91) of the pixel cells 71 which are disposed in the horizontal direction, so that the horizontal line as the scanning object moves in the vertical direction. Here, the drive for the gate lines G(A) or G(B) means that drive pulses are successively inputted to the gate lines G(A) or G(B), respectively.

As has been described above, the data line driving circuit 62 successively drives the data lines D by using the shift register. Also, the gate line driving circuit 63 successively drives the gate lines G(A) and G(B) in units of two lines. As a result, the data is successively written to the capacitors 83(93) of the pixel cells 71, so that the liquid crystal layer 53 is excited, thereby displaying a desired image on the screen.

In addition, the gate line driving circuit 63 successively shifts the data which is inputted thereto from the outside and which is used to inspect a fault caused on the substrate 51, thereby either driving the gate lines G(A) and G(B) in units of two lines or driving ones of the gate lines G(A) and G(B).

The detection circuit 64 is composed of switches 101 and 102, comparators 103 and 104, a control circuit 105, and the like.

The switch 101, for example, is constituted by the FET, and a gate of the switch 101 is connected to the control circuit 105. A drain of the switch 101 is connected to the data line $D_{n-1}$, and a source thereof is connected to the data line $D_n$ adjacent to the data line $D_{n-1}$. Also, the switch 101 connects the data line $D_{n-1}$ and the data line $D_n$ to each other in accordance with a control signal supplied from the control circuit 105.

The switch 102, for example, is constituted by the FET similarly to the case of the switch 101, and a gate of the switch 102 is connected to the control circuit 105. A drain of the switch 102 is connected to the data line $D_{n+1}$, and a source thereof is connected to the data line $D_{n+2}$ adjacent to the data line $D_{n+1}$. Also, the switch 102 connects the data line $D_{n+1}$ and the data line $D_{n+2}$ to each other in accordance with a control signal supplied from the control circuit 105.

The comparator 103 compares the potentials of the data lines $D_{n-1}$ and $D_n$ with each other. The comparator 103 outputs a signal having a predetermined potential VS as an output signal having smaller one of the potentials of the data lines $D_{n-1}$ and $D_n$, and outputs a signal having a predetermined potential VB as an output signal having larger one of the potentials of the data lines $D_{n-1}$ and $D_n$. Note that, when the potentials of the data lines $D_{n-1}$ and $D_n$ are equal to each other, the comparator 103 outputs the signal having the potential VS as one output signal having one of the potentials of the data lines $D_{n-1}$ and $D_n$, and outputs the output signal having the potential VB as the other output signal having the other of the potentials of the data lines $D_{n-1}$ and $D_n$ in accordance with its characteristics. This similarly applies to the comparator 104 which will be described below.

The comparator 104 compares the potentials of the data lines $D_{n+1}$ and $D_{n+2}$ with each other. The comparator 104 outputs a signal having a predetermined potential VS as an output signal having smaller one of the potentials of the data lines $D_{n+1}$ and $D_{n+2}$, and outputs a signal having a predetermined potential VB as an output signal having larger one of the potentials of the data lines $D_{n+1}$ and $D_{n+2}$. A user detects a fault, such as a line fault, short circuit or disconnection within the pixel cells 71, or a fault in holding performance of the capacitors 83(93), which is caused on the substrate 51 in accordance with the output signals sent from the comparators 103 and 104, thereby specifying a faulty portion.

The control circuit 105 generates a control signal at a predetermined timing and outputs the control signal thus generated to each of the gates of the switches 102 and 102.

Next, a description will now be given with respect to an example of the potentials of the signals inputted to the data lines D, respectively, when a fault caused on the substrate 51 is inspected with reference to a Table of FIG. 4.

It is noted that in the Table of FIG. 4, the reference symbols of the data lines D are described in the uppermost column, and the reference symbols of the gate lines G(A) and G(B) are described in a column at a left-hand end.

In addition, in the Table of FIG. 4, in each of the columns in and after the second column from the upper side, the potential of the signal which is inputted to corresponding one of the data lines D having the reference symbol described in the uppermost column from the column concerned when the gate lines G(A) and G(B) having the respective reference symbols described in the column at the left-hand end from the column concerned is expressed in the form of either an H level (represented by "H" in FIG. 4) or an L level (represented by "L" in FIG. 4) having a polarity different from that of the H level with respect to a reference value Ve. The signal having the potential of the H level (hereinafter referred to as "the H level signal"), for example, corresponds to "1" of the data inputted from the outside to the data line driving circuit 62. On the other hand, the signal having the potential of the L level (hereinafter referred to as "the L level signal"), for example, corresponds to "0" of the data inputted from the outside to the data line driving circuit 62.

In the example shown in Table of FIG. 4, when the gate lines $G_{m'-1}$(A) and $G_{m'-1}$(B) are driven in units of two lines, the data line driving circuit 62 inputs the H level signal, the L level signal, the H level signal, and the L level signal to the data line $D_{n-1}$, the data line $D_n$, the data line $D_{n+1}$, and the data line $D_{n+2}$, respectively. In addition, when the gate lines $G_{m'}$(A) and $G_{m'}$(B) are driven in units of two lines, the data line driving circuit 62 inputs the L level signal, the H level signal, the L level signal, and the H level signal to the data line $D_{n-1}$, the data line $D_n$, the data line $D_{n+1}$, and the data line $D_{n+2}$, respectively.

Also, when the gate lines $G_{m'+1}$(A) and $G_{m'+1}$(B) are driven in units of two lines, the data line driving circuit 62 inputs the H level signal, the L level signal, the H level signal, and the L level signal to the data line $D_{n-1}$, the data line $D_n$, the data line $D_{n+1}$, and the data line $D_{n+2}$, respectively.

As has been described above, in the inspection for a fault, the data line driving circuit 62 inputs the signals having the potentials different in polarity from each other to each adjacent two data lines D, respectively. Therefore, when no fault is caused on the substrate 51, the charges originating from the potentials which are different in polarity from each other with respect to the reference value Ve are accumulated in the capacitors 83 and 93 of the pixel cells 71 which are adjacent to each other in the horizontal direction. On the other hand, when short circuit is caused between the adjacent two pixel cells 71, the charges accumulated in the capacitors 83 and 93 of the pixel cells 71 which are adjacent to each other in the horizontal direction become ones originating from the same potential. Consequently, the user can detect the short circuit between the each adjacent two pixel cells based on the results of comparison in potential between the each adjacent two data lines D through which the charges accumulated in the capacitors 83 and 93 are outputted, respectively. Here, the comparison results are outputted from the comparators 103(104), respectively.

Next, an inspection for the pixel cells 71-5 and 71-6 will now be described with reference to timing charts of FIGS. 5 to 7. It is noted that in each of the timing charts of FIGS. 5 to 7, an axis of abscissa represents a time, and axis of ordinate represents a potential. In addition, it is assumed that in an example shown in the time chart of FIG. 5, no fault is caused.

Figure 5:
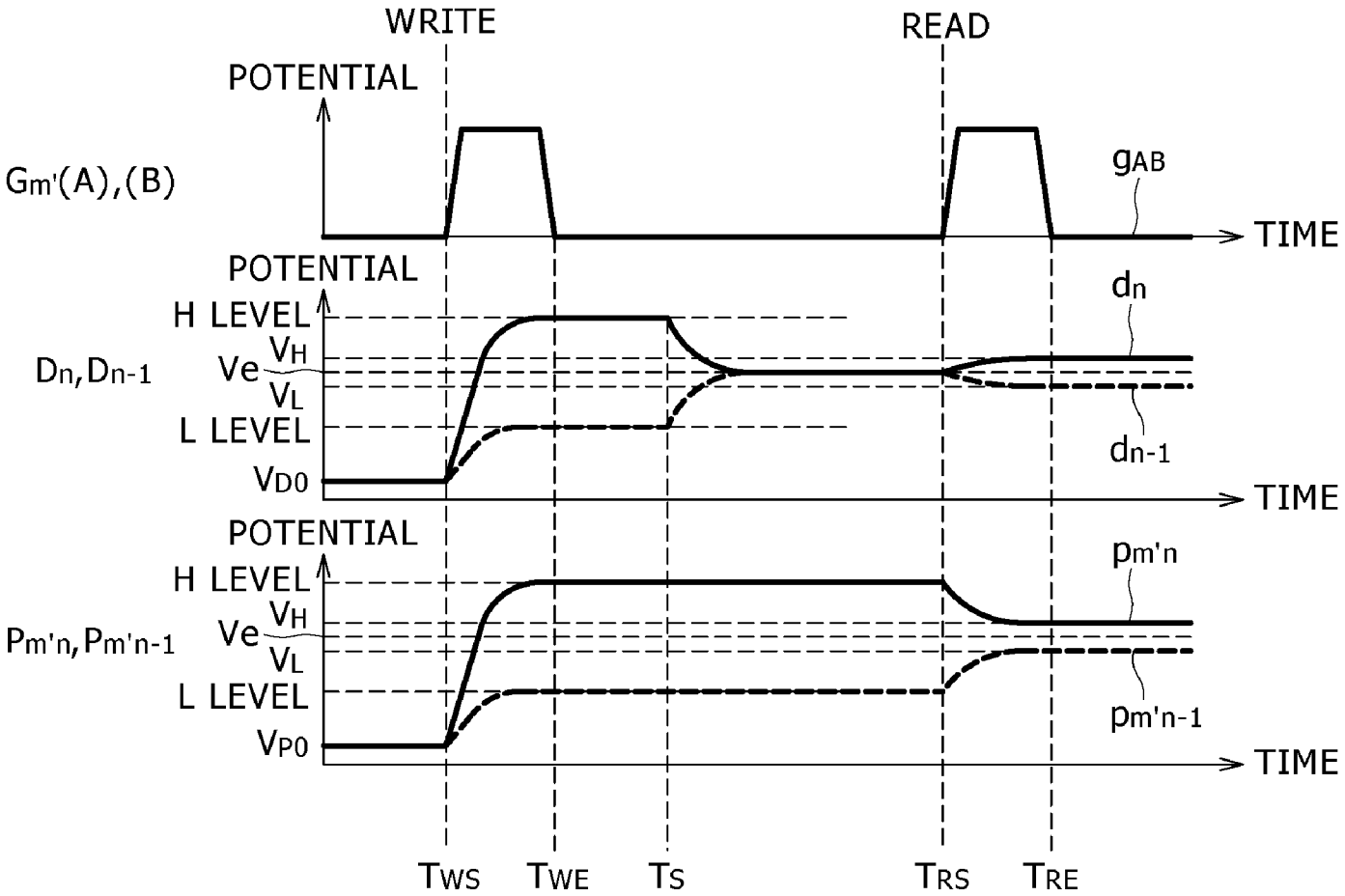
FIG. 5 is a timing chart explaining an inspection for pixel cells.

Firstly, as shown in FIG. 5, the liquid crystal display device 50 carries out an operation for writing data to each of the pixel cells 71-5 and 71-6, and an operation for reading out data from each of the pixel cells 71-5 and 71-6.

More specifically, as shown by a waveform $g_{AB}$ of FIG. 5, at a time $T_{WS}$, the gate line driving circuit 63 drives the gate lines $G_m$(A) and $G_m$(B). That is to say, the gate line driving circuit 63 inputs drive pulses to the gate lines $G_m$(A) and $G_m$(B), respectively. As a result, each of the pixel cells 71-5 and 71-6 is held in an ON state while each of the drive pulses is held in an ON state.

In addition, at the time $T_{WS}$, the data line driving circuit 62 inputs the L level signal to the data line $D_{n-1}$. As a result, as shown by a waveform $d_{n-1}$ of FIG. 5, the potential of the data line $D_{n-1}$ gradually increases from its initial value $V_{DO}$ to reach the L level. As has been described above, at the time $T_{WS}$, the switch of the pixel cell 71-5 is turned ON. As a result, as shown by a waveform $p_{m'n-1}$ of FIG. 5, a potential $P_{m'n-1}$ at the electrode of the pixel cell 71-5 gradually increases from its initial value $V_{PO}$ to reach the L level.

Moreover, at the time $T_{WS}$, the data line driving circuit 62 inputs the H level signal to the data line $D_n$. As a result, as shown by a waveform $d_n$ of FIG. 5, the potential of the data line $D_n$ gradually increases from its initial value $V_{DO}$ to reach the H level. As has been described above, at the time $T_{WS}$, the switch of the pixel cell 71-6 is turned ON. As a result, as shown by a waveform $p_{m'n}$ of FIG. 5, a potential $P_{m'n}$ at the electrode of the pixel cell 71-6 gradually increases from its initial value $V_{PO}$ to reach the H level.

The liquid crystal display device 50 carries out an operation for writing the data to each of the pixel cells 71-5 and 71-6 in the manner as described above.

Next, when at a time $T_{WE}$, the drive for each of the gate lines $G_m$(A) and $G_m$(B) is stopped, that is, the drive pulses for the respective gate lines $G_m$(A) and $G_m$(B) are set to OFF, the switches of the pixel cells 71-5 and 71-6 are turned OFF, so that the capacitors of the pixel cells 71-5 and 71-6 hold the charges accumulated therein. As a result, as shown by the waveform $p_{m'n-1}$ of FIG. 5, the potential $P_{m'n-1}$ at the electrode of the pixel cell 71-5 is held at the L level. Also, the potential $P_{m'n}$ at the electrode of the pixel cell 71-6, as shown by the waveform $p_{m'n}$ of FIG. 5, is held at the H level. In addition, the data line driving circuit 62 stops the input of the signal to each of the data lines $D_{n-1}$ and $D_n$.

After that time, at a time $T_S$, the switch 101 is turned ON in accordance with the control signal supplied from the control circuit 105. As a result, each of the potentials of the data lines $D_{n-1}$ and $D_n$ gradually approaches the reference value Ve as an intermediate value between the H level and the L level, and both of them are stabilized at the reference value Ve. After that, the switch 101 is turned OFF in accordance with the control signal supplied from the control circuit 105, and the data line driving circuit 62 sets each of the data lines $D_{n-1}$ and $D_n$ in a high impedance state.

Next, at a time $T_{RS}$, as shown by the waveform $g_{AB}$ of FIG. 5 the gate line driving circuit 63 drives the gate lines $G_m$(A) and $G_m$(B). As a result, the switches of the pixel cells 71-5 and 71-6 are turned ON again.

Therefore, at the time $T_{RS}$, as shown by the waveform $d_{n-1}$ of FIG. 5, the potential of the data line $D_{n-1}$ gradually drops from the reference value Ve due to the potential $P_{m'n-1}$ at the electrode of the pixel cell 71-5 to become a value $V_L$ ($V_L$<Ve). In addition, as shown by the waveform $p_{m'n-1}$ of FIG. 5, the potential $P_{m'n-1}$ at the electrode of the pixel cell 71-5 gradually increases due to the potential of the data line $D_{n-1}$ to become the value $V_L$.

On the other hand, as shown by the waveform $d_n$ of FIG. 5, the potential of the data line $D_n$ gradually increases from the reference value Ve due to the potential $P_{m'n}$ at the electrode of the pixel cell 71-6 to become a value $V_H$ ($V_H$>Ve). In addition, as shown by the waveform $p_{m'n}$ of FIG. 5, the potential $P_{m'n}$ at the electrode of the pixel cell 71-6 gradually drops from the H level due to the potential of the data line $D_n$ to become the value $V_H$.

Next, when at a time $T_{RE}$, the drive pulses for the respective gate lines $G_m$(A) and $G_m$(B) are set to OFF, the switches of the pixel cells 71-5 and 71-6 are turned OFF.

The liquid crystal display device 50 carries out an operation for reading out the data from the pixel cells 71-5 and 71-6 in the manner as described above.

After that time, the comparator 103 compares the potential $V_L$ of the data line $D_{n-1}$ and the potential $V_H$ of the data line $D_n$ with each other. As a result, the comparator 103 outputs the signal having the potential VS as the output signal having the smaller potential of the data line $D_{n-1}$, and outputs the signal having the potential VB as the output signal having the larger potential of the data line $D_n$. The user judges whether or not a fault is caused by checking the output signals of the respective data lines $D_{n-1}$ and $D_n$.

In the example of FIG. 5, the L level signal and the H level signal are inputted to the data lines $D_{n-1}$ and $D_n$, respectively. That is to say, the data corresponding to the L level signal is written to the capacitor of the pixel cell 71-5, and the data corresponding to the H level signal is written to the capacitor of the pixel cell 71-6. As a result, when no fault is caused, the potential of the output signal sent from the data line $D_{n-1}$ becomes the potential VS, and the potential of the output signal sent from the data line $D_n$ becomes the potential VB. Therefore, when the potential of the output signal from the data line $D_{n-1}$ is the potential VS and the potential of the output signal from the data line $D_n$ is the potential VB as shown in the timing chart of FIG. 5, the user judges that a fault is caused in none of the pixel cells 71-5 and 71-6.

On the other hand, a detailed description will be given hereinafter with respect to the case where a fault is caused in the pixel cell 71-5 with reference to the timing chart of FIG. 6. Note that, with regard to the fault caused in the pixel cell 71-5, for example, there are given a fault in the switch of the pixel cell 71-5 (for example, the switch is caused to be a normally turned-ON or OFF state), an open fault in connection between the data line $D_{n-1}$ and the switch of the pixel cell 71-5, disconnection or short circuit on the electrode side (on the capacitor side) of the switch, disconnection or short circuit in the data line $D_{n-1}$ connected to the pixel cell 71-5, disconnection or short circuit in the gate line $G_m$(A) connected to the pixel cell 71-5, and the like. However, in the example of FIG. 6, it is assumed that there is the fault in which the switch of the pixel cell 71-5 is caused to be the normally turned-ON state.

In this case, even when at the time $T_{WS}$, the gate line $G_{m'}(A)$ is driven, the switch of the pixel cell 71-5 is held in the OFF state. Therefore, as shown by a waveform $p'_{m'n-1}$ of FIG. 6, at the time $T_{WS}$, the potential $P_{m'n-1}$ at the electrode of the pixel cell 71-5 is held at its initial value $V_{PO}$. In addition, as shown by a waveform $d'_{n-1}$ of FIG. 6, at the time $T_{RS}$, the potential of the data line $D_{n-1}$ is still held at the reference value Ve as shown by a waveform $d'_{n-1}$ of FIG. 6 because even when at the time $T_{RS}$, the gate lines $G_{m'}(A)$ is driven, the switch of the pixel cell 71-5 is held in the OFF state.

However, a magnitude relationship between the reference value Ve as the potential of the data line $D_{n-1}$ and the value $V_H$ as the potential of the data line $D_n$ is identical to that between the potential $V_L$ of the data line $D_{n-1}$ and the potential $V_H$ of the data line $D_n$ when no fault is caused. Thus, the output signal outputted from the comparator 103 becomes identical to that when a fault is caused in none of the pixel cells 71-5 and 71-6. Therefore, the user judges that a fault is caused in none of the pixel cells 71-5 and 71-6 by mistake. That is to say, none of the faults in the pixel cells 71-5 and 71-6 is detected.

Figure 6:
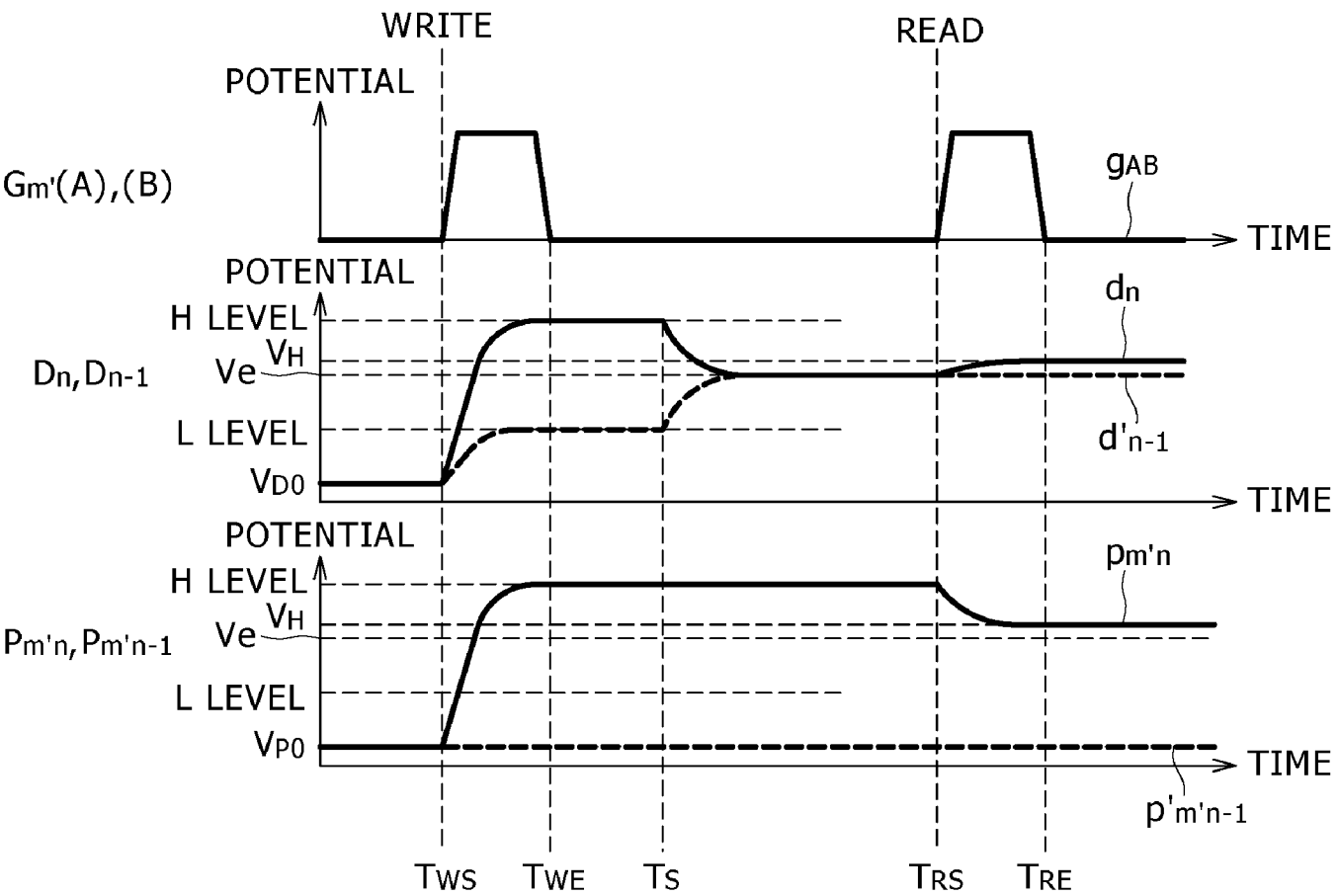
FIG. 6 is a timing chart explaining another inspection for pixel cells.
Figure 7:
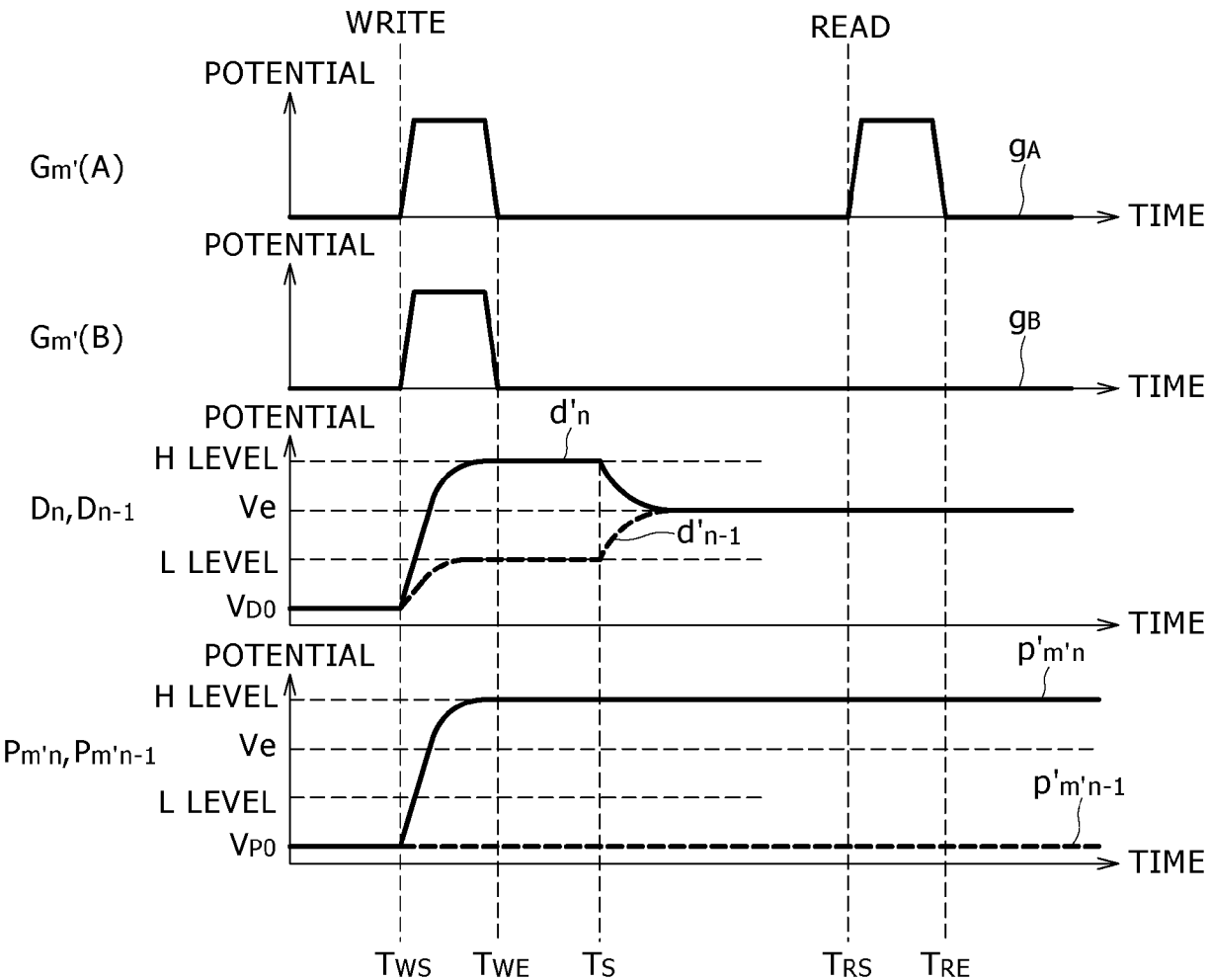
FIG. 7 is a timing chart explaining still another inspection for pixel cells.

In order to cope with this situation, for example, the liquid crystal display device 50, as shown in FIG. 7, also carries out an operation for writing the data to each of the pixel cells 71-5 and 71-6, and an operation for reading out the data from the pixel cell 71-5. Note that, in an example of FIG. 7, it is assumed that the same fault as that of the example of FIG. 6 is caused in the pixel cell 71-5.

More specifically, as shown by waveforms $g_A$ and $g_B$ of FIG. 7, at the time $T_{WS}$, the gate line driving circuit 63 drives the gate lines $G_{m'}(A)$ and $G_{m'}(B)$. However, since the switch of the pixel cell 71-5 is still held in the OFF state, as shown by a waveform $p'_{m'n-1}$ of FIG. 7, the potential $P_{m'n-1}$ at the electrode of the pixel cell 71-5 is held at its initial value $V_{PO}$ similarly to the case of FIG. 6. In addition, even when at the time $T_{RS}$, the gate line $G_{m'}(A)$ is driven, the switch of the pixel cell 71-5 is still held in the OFF state. Hence, at the time $T_{RS}$, as shown by a waveform $d'_{n-1}$ of FIG. 6, the potential of the data line $D_{n-1}$ is still held at the reference value Ve.

On the other hand, in the case of the example shown in FIG. 7, unlike the case of the example shown in FIG. 6, since as shown by the waveform $g_B$ of FIG. 7, no gate line $G_{m'}(B)$ is driven at the time $T_{RS}$, no switch of the pixel cell 71-6 is turned ON. As a result, the potential $P_{m'n}$ at the electrode of the pixel cell 71-6 is still held at the reference value Ve as shown by the waveform $p'_{m'n}$ of FIG. 7.

As has been described above, each of the potentials of the data lines $D_{n-1}$ and $D_n$ is set to the reference value Ve. Thus, the comparator 103, for example, outputs the signal having the potential VB as the output signal sent from the data line $D_{n-1}$ and outputs the signal having the potential VS as the output signal sent from the data line $D_n$.

On the other hand, when no fault is caused, the potential of the data line $D_{n-1}$ does not become the reference value Ve, but becomes the value $V_L$ smaller than reference value Ve. Hence, unlike the case of the example of FIG. 7, the potential of the output signal from the data line $D_{n-1}$ becomes the potential VS and the potential of the output signal from the data line $D_n$ becomes the potential VB. Consequently, in the example of FIG. 7, the user can judge that the fault is caused in the pixel cell 71-5 by confirming whether or not the potentials of the output signals from the respective data lines $D_{n-1}$ and $D_n$ are different from those in the case where no fault is caused.

Next, a description will now be given with respect to the case where the liquid crystal display device 50 executes inspection processing for inspecting whether or not a fault is caused with reference to a flow chart of FIG. 8. This inspection processing starts to be executed when data for the inspection is inputted from the outside to each of the data line driving circuit 62 and the gate line driving circuit 63.

In Step S1, the liquid crystal display device 50 executes straight-polarity both reading-out processing. Here, in the straight-polarity both reading-out processing, the signals having the respective potentials shown in FIG. 4 are inputted to the data lines D, respectively, and the write and read of the data to and from both of the adjacent two pixel cells 71 is carried out. The details of the straight-polarity both reading-out processing will be described later with reference to a flow chart of FIG. 9.

In Step S2, the liquid crystal display device 50 executes reverse-polarity both reading-out processing. Here, in the reverse-polarity both reading-out processing, the signals having the respective potentials which are reverse in polarity to those shown in FIG. 4 with respect to the reference value Ve are inputted to the data lines D, respectively, and the write and read of the data to and from both of the adjacent two pixel cells 71 are carried out.

In Step S3, the liquid crystal display device 50 executes straight-polarity odd-numbered cell single reading-out processing. Here, in the straight-polarity odd-numbered cell single reading-out processing, the signals having the respective potentials shown in FIG. 4 are inputted to the data lines D, respectively, the write of the data to each of the adjacent two pixel cells 71 is carried out, and the read of the data from the odd-numbered pixel cell 71 from the left-hand side of the adjacent two pixel cells 71 is carried out. The details of the straight-polarity odd-numbered cell single reading-out processing will be described later with reference to a flow chart of FIG. 10.

In Step S4, the liquid crystal display device 50 executes reverse-polarity odd-numbered cell single reading-out processing. Here, in the reverse-polarity odd-numbered cell single reading-out processing, the signals having the respective potentials which are reverse in polarity to those shown in FIG. 4 with respect to the reference value Ve are inputted to the data lines D, respectively, the write of the data to each of the adjacent two pixel cells 71 is carried out, and the read of the data from the odd-numbered pixel cell 71 from the left-hand side of the adjacent two pixel cells 71 is carried out.

In Step S5, the liquid crystal display device 50 executes straight-polarity even-numbered cell single reading-out processing. Here, in the straight-polarity even-numbered cell single reading-out processing, the signals having the respective potentials shown in FIG. 4 are inputted to the data lines D, respectively, the write of the data to each of the adjacent two pixel cells 71 is carried out, and the read of the data from the even-numbered pixel cell 71 from the left-hand side of the adjacent two pixel cells 71 is carried out.

In Step S6, the liquid crystal display device 50 executes reverse-polarity even-numbered cell single reading-out processing. Here, in the reverse-polarity even-numbered cell single reading-out processing, the signals having the respective potentials which are reverse in polarity to those shown in FIG. 4 with respect to the reference value Ve are inputted to the data lines D, respectively, the write of the data to each of the adjacent two pixel cells 71 is carried out, and the read of the data from the even-numbered pixel cell 71 from the left-hand side of the adjacent two pixel cells 71 is carried out.

As has been described above, the liquid crystal display device 50 executes not only the straight-polarity both reading-out processing, straight-polarity odd-numbered cell single reading-out processing, and straight-polarity even-numbered cell single reading-out processing for inputting the signals having the respective potentials shown in FIG. 4 to the data lines D, respectively, but also the reverse-polarity both reading-out processing, reverse-polarity odd-numbered cell single reading-out processing, and reverse-polarity even-numbered single reading-out processing for inputting the signals having the respective potentials which are reverse in polarity to those shown in FIG. 4 with respect to the reference value Ve to the data lines D, respectively. As a result, the fault can be more precisely detected.

That is to say, when the potentials of the adjacent two data lines D are equal to each other, each of the comparators 103 and 104 outputs the signal having the potential VS as the output signal from one of the adjacent two data lines D, and output the signal having the potential VB as the output signal from the other of the adjacent two data lines D based on its characteristics. Therefore, even when a fault is caused, the potential of the output signal becomes identical to that of the output signal when no fault is caused. As a result, the user may judge that no fault is caused by mistake.

Even in such a case, however, the liquid crystal display device 50 inspects both the case where the potentials of the signals inputted to the respective data lines D are those of the signals each having the predetermined polarity with respect to the reference value Ve, and the case where the potentials of the signals inputted to the respective data lines D are those of the signals which are reverse in polarity to those of the signals shown in FIG. 4 with respect to the reference value Ve. As a result, the user can judge that no fault is caused when the potential of the output signal outputted from the comparator 103(104) and obtained from the inspection results about one of the two cases is different from that of the output signal outputted from the comparator 103(104) and obtained from the inspection results about the other of them, that is, when the magnitude relationship between the output signals from the adjacent two data lines D changes depending on changes in polarity of the potentials of the signals inputted to the respective data lines D with respect to the reference value Ve. On the other hand, the user can judge that the fault is caused when the potentials of the output signals obtained from the inspection results about both of them are identical to each other.

In addition, in the liquid crystal display device 50, the different gate lines G(A) and G(B) are connected to the adjacent pixel cells 71, respectively, and the gate line driving circuit 63 controls the paired gate lines G(A) and G(B) independently of each other. Here, the liquid crystal display device 50 executes not only the straight-polarity both reading-out processing and reverse-polarity both reading-out processing for carrying out the write and read of the data to and from each of the adjacent two pixel cells 71, but also the straight-polarity odd-numbered cell single reading-out processing, reverse-polarity odd-numbered cell single reading-out processing, straight-polarity even-numbered cell single reading-out processing, and reverse-polarity even-numbered cell single reading-out processing for carrying out the write of the data to each of the adjacent two pixel cells 71, and carrying out the read of the data from one of the adjacent two pixel cells 71. As a result, the fault can be more precisely detected.

For example, in the case where the magnitude relationship of one set of the potentials of the adjacent two data lines D is identical to that of the other set of the potentials of the adjacent two data lines D, even when the potentials of the respective data lines D are different from one another, the comparators 103 and 104 output the output signals identical to each other. Therefore, even when the fault is caused, the user may judge that no fault is caused by mistake because the potentials of the output signals are identical to those of the output signals when no fault is caused.

Even in such a case, the light liquid crystal display device 50 carries out the inspection for reading out the data only from one of the adjacent two pixel cells 71, which results in that as the inspection results, the possibility that the potential of the output signal outputted from the comparator 103(104) is different from that of the output signal outputted from the comparator 103(104) when no fault is caused increases. As a result, the user can more precisely detect the fault.

As has been described above, since the user can more precisely detect the fault, he/she can narrow down the faulty portion in more detail. As a result, the user can specify the faulty portion in more detail.

Next, a description will now be given with respect to the details of the straight-polarity both reading-out processing in Step S1 of FIG. 8 with reference to a flow chart of FIG. 9. It is noted that although a description is given below with respect to the case where the gate lines $G_{m'-1}$(A) and $G_{m'-1}$(B) are driven with reference to the flow chart of FIG. 9, the drive is successively performed for other gate lines G(A) and G(B) similarly to the case of FIG. 9.

In Step S11, the gate line driving circuit 63 inputs the drive pulses to the gate lines $G_{m'-1}$(A) and $G_{m'-1}$(B), respectively. In Step S12, the switches of the pixel cells 71-1, 71-3, and 71-2, 71-4 connected to the gate lines $G_{m'-1}$(A) and $G_{m'-1}$(B), respectively, are turned ON, thereby connecting the data lines D to the electrodes thereof, respectively.

In Step S13, as shown in FIG. 4, the data line driving circuit 62 inputs the H level signal to each of the odd-numbered data lines D from the left-hand side (hereinafter referred to as "the odd-numbered data lines"), and inputs the L level signals to each of the even-numbered data lines D from the left-hand side (hereinafter referred to as "the even-numbered data lines").

In Step S14, the capacitors of the pixel cells 71-1, 71-3, and 71-2, 71-4 connected to the gate lines $G_{m'-1}$(A) and $G_{m'-1}$(B), respectively, accumulate therein the charges based on the potentials of the signals inputted thereto from the data line driving circuit 62 through the respective switches.

In Step S15, the switches of the pixel cells 71-1, 71-3, and 71-2, 71-4 connected to the gate lines $G_{m'-1}$(A) and $G_{m'-1}$(B), respectively, are turned OFF in response to the OFF state of the drive pulses inputted the gate lines $G_{m'-1}$(A) and $G_{m'-1}$(B), thereby disconnecting the electrodes of the pixel cells 71-1, 71-3, and 71-2, 71-4 from the data lines D, respectively. As a result, the accumulation of the charges in the capacitors of the pixel cells 71-1 to 71-4 is stopped.

In Step S16, the capacitors of the pixel cells 71-1 to 71-4 hold the charges accumulated therein. In Step S17, the switches 101 and 102 connect the odd-numbered data lines and the even-numbered data lines adjacent thereto to each other in accordance with the control signals inputted thereto from the control circuit 105, respectively. As a result, the potential of each of the odd-numbered data lines and the even-numbered data lines adjacent thereto becomes equal to the reference value Ve.

In Step S18, the switches 101 and 102 disconnect the odd-numbered data lines and the even-numbered data lines adjacent thereto from each other in accordance with control signals inputted thereto from the control circuit 105, respectively. In Step S19, the data line driving circuit 62 sets each of the data lines D in a high impedance state.

In Step S20, the gate line driving circuit 63 inputs drive pulses to the gate lines $G_{m'-1}$(A) and $G_{m'-1}$(B), respectively. In Step S21, the switches of the pixel cells 71-1 to 71-4 are turned ON to connect the data lines D to the electrodes of the pixel cells 71-1 to 71-4, respectively. As a result, the potentials of the capacitors of the pixel cells 71-1 to 71-4 become identical to those at the electrodes of the pixel cells 71-1 to 71-4, respectively.

In Step S22, the switches of the pixel cells 71-1 to 71-4 are turned OFF in response to end of the drive pulses inputted to the gate lines $G_{m'-1}(A)$ and $G_{m'-1}(B)$, respectively, to disconnect the data lines D and the electrodes of the pixel cells 71-1 to 71-4 from each other. In Step S23, the comparator 103 compares the potentials of the odd-numbered data line $D_{n-1}$ and the even-numbered data line $D_n$ adjacent thereto with each other. Also, the comparator 104 compares the potentials of the odd-numbered data line $D_{n+1}$ and the even-numbered data line $D_{n+2}$ adjacent thereto with each other. In Step S24, the comparator 103 outputs a signal having a potential VS as an output signal having smaller one of the potentials of the odd-numbered data line $D_{n-1}$ and the even-numbered data line $D_n$ adjacent thereto, and outputs a signal having a potential VB as an output signal having larger one of the potentials of the odd-numbered data line $D_{n-1}$ and the even-numbered data line $D_n$ adjacent thereto. The comparator 104 outputs a signal having a potential VS as an output signal having smaller one of the potentials of the odd-numbered data line $D_{n+1}$ and the even-numbered data line $D_{n+2}$ adjacent thereto, and outputs a signal having a potential VB as an output signal having larger one of the potentials of the odd-numbered data line $D_{n+1}$ and the even-numbered data line $D_{n+2}$ adjacent thereto.

Figure 9:
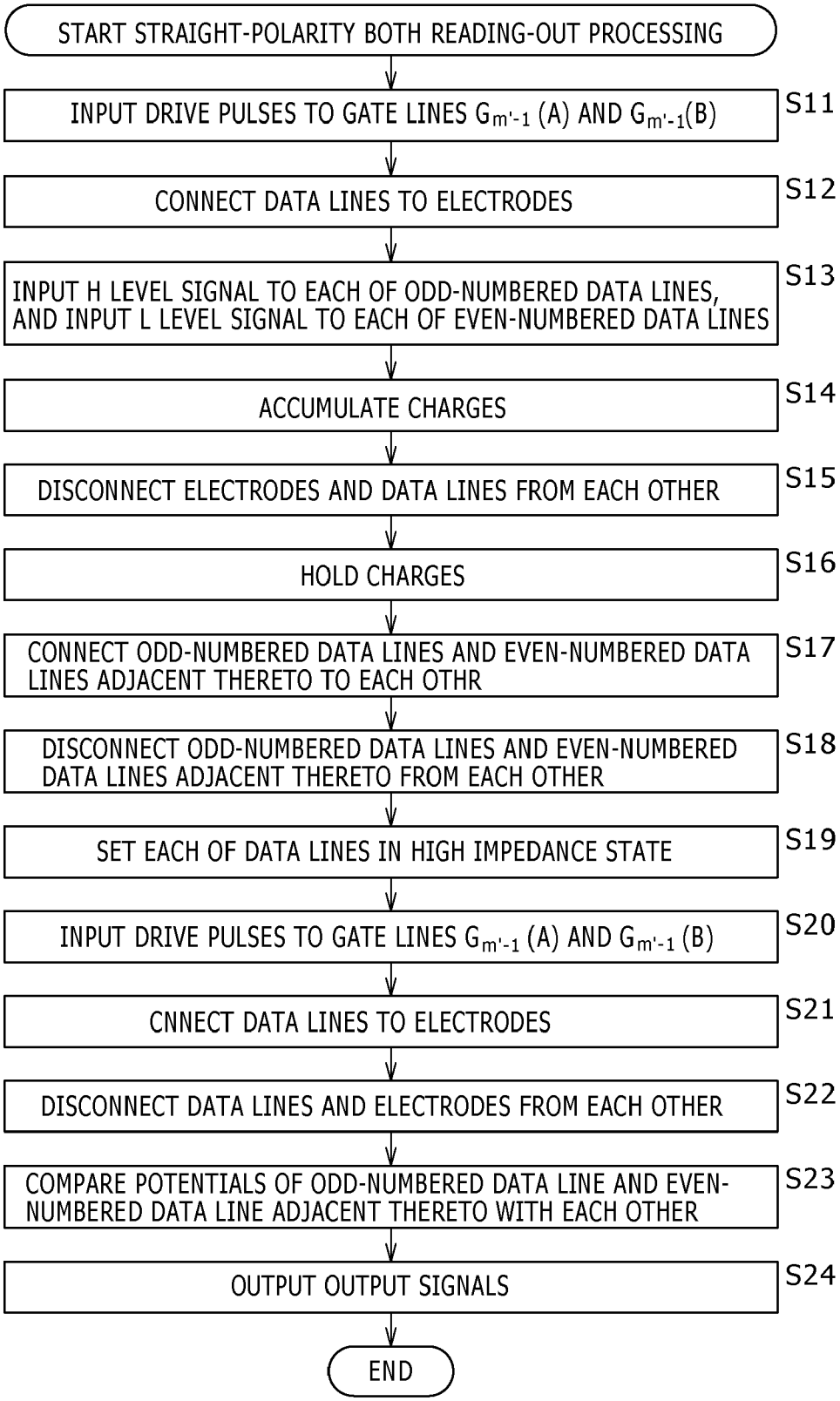
FIG. 9 is a flow chart explaining details of straight-polarity both reading-out processing shown in FIG. 8.

It is noted that while a description is omitted here for the sake of simplicity, the reverse-polarity both reading-out processing in Step S2 of FIG. 8 is also executed similarly to the case of the straight-polarity both reading-out processing shown in FIG. 9. In this case, in Step S13 of FIG. 9, the data line driving circuit 62 inputs the L level signal to each of the odd-numbered data lines, and inputs the H level signal to each of the even-numbered data lines.

Next, a description will now be given with respect to the details of the straight-polarity odd-numbered cell single reading-out processing in Step S3 of FIG. 8 with reference to a flow chart of FIG. 10. It is noted that although a description is given below with respect to the case where the gate lines $G_{m'-1}(A)$ and $G_{m'-1}(B)$ are driven with reference to FIG. 10, the drive is successively performed for other gate lines G(A) and G(B) similarly to the case of FIG. 10.

Since processing from Step S31 to Step S39 is the same as that from Step S11 to Step S19 of FIG. 9, a description thereof is omitted here for the sake of simplicity.

In Step S40, the gate line driving circuit 63 inputs the drive pulse to the gate line $G_{m'-1}(A)$. In Step S41, the switches of the pixel cells 71-1 and 71-3 connected to the gate line $G_{m'-1}(A)$ are turned ON, thereby connecting the odd-numbered data lines to the electrodes of the pixel cells 71-1 and 71-3, respectively. As a result, the charges accumulated in the capacitors of the pixel cells 71-1 and 71-3 are outputted to the odd-numbered data lines, respectively, so that the potentials of the pixel cells 71-1 and 71-3 become identical to those at the electrodes of the pixel cells 71-1 and 71-3, respectively.

In Step S42, the switches of the pixel cells 71-1 and 71-3 are turned OFF in response to end of the drive pulse inputted to the gate line $G_{m'-1}(A)$, thereby disconnecting the odd-numbered data lines and the electrodes of the pixel cells 71-1 and 71-3 from each other. In Step S43, the comparator 103 compares the potentials of the odd-numbered data line $D_{n-1}$ and the even-numbered data line $D_n$ adjacent thereto with each other. Also, the comparator 104 compares the potentials of the odd-numbered data line $D_{n+1}$ and the even-numbered data line $D_{n+2}$ adjacent thereto with each other. In Step S44, the comparator 103 outputs a signal having a potential VS as an output signal having smaller one of the potentials of the odd-numbered data line $D_{n-1}$ and the even-numbered data line $D_n$ adjacent thereto, and outputs a signal having a potential VB as an output signal having larger one of the potentials of the odd-numbered data line $D_{n-1}$ and the even-numbered data line $D_n$ adjacent thereto. The comparator 104 outputs the signal having the potential VS as an output signal having smaller one of the potentials of the odd-numbered data line $D_{n+1}$ and the even-numbered data line $D_{n+2}$ adjacent thereto, and outputs the signal having the potential VB as an output signal having larger one of the potentials of the odd-numbered data line $D_{n+1}$ and the even-numbered data line $D_{n+2}$ adjacent thereto.

It is noted that while a description is omitted here for the sake of simplicity, each of the reverse-polarity odd-numbered cell single reading-out processing in Step S4 of FIG. 8, the straight-polarity even-numbered cell single reading-out processing in Step S5 of FIG. 8, and the reverse-polarity even-numbered cell single reading-out processing in Step S6 of FIG. 8 is also executed similarly to the case of the straight-polarity odd-numbered cell single reading-out processing shown in FIG. 10. However, in the reverse-polarity odd-numbered cell single reading-out processing in Step S4 of FIG. 8, in Step S33 of FIG. 10, the data line driving circuit 62 inputs the L level signal to each of the odd-numbered data lines, and inputs the H level signal to each of the even-numbered data lines. In addition, in the straight-polarity even-numbered cell single reading-out processing in Step S5 of FIG. 8, the gate line driving circuit 63 inputs the drive pulse to the gate line $G_{m'-1}(B)$ in Step S40, the even-numbered data lines are connected to the electrodes, respectively, in Step S41, and the even-numbered data lines and the electrodes are disconnected from each other in Step S42.

Moreover, the reverse-polarity even-numbered cell single reading-out processing in Step S6 of FIG. 8, in Step S33 of FIG. 10, the same processing as the reserve-polarity odd-numbered cell single reading-out processing in Step S4 of FIG. 8 is executed, and in Steps S40 to S42, the same processing as the straight-polarity even-numbered cell single reading-out processing in Step S5 of FIG. 8 is executed.

Figure 11:
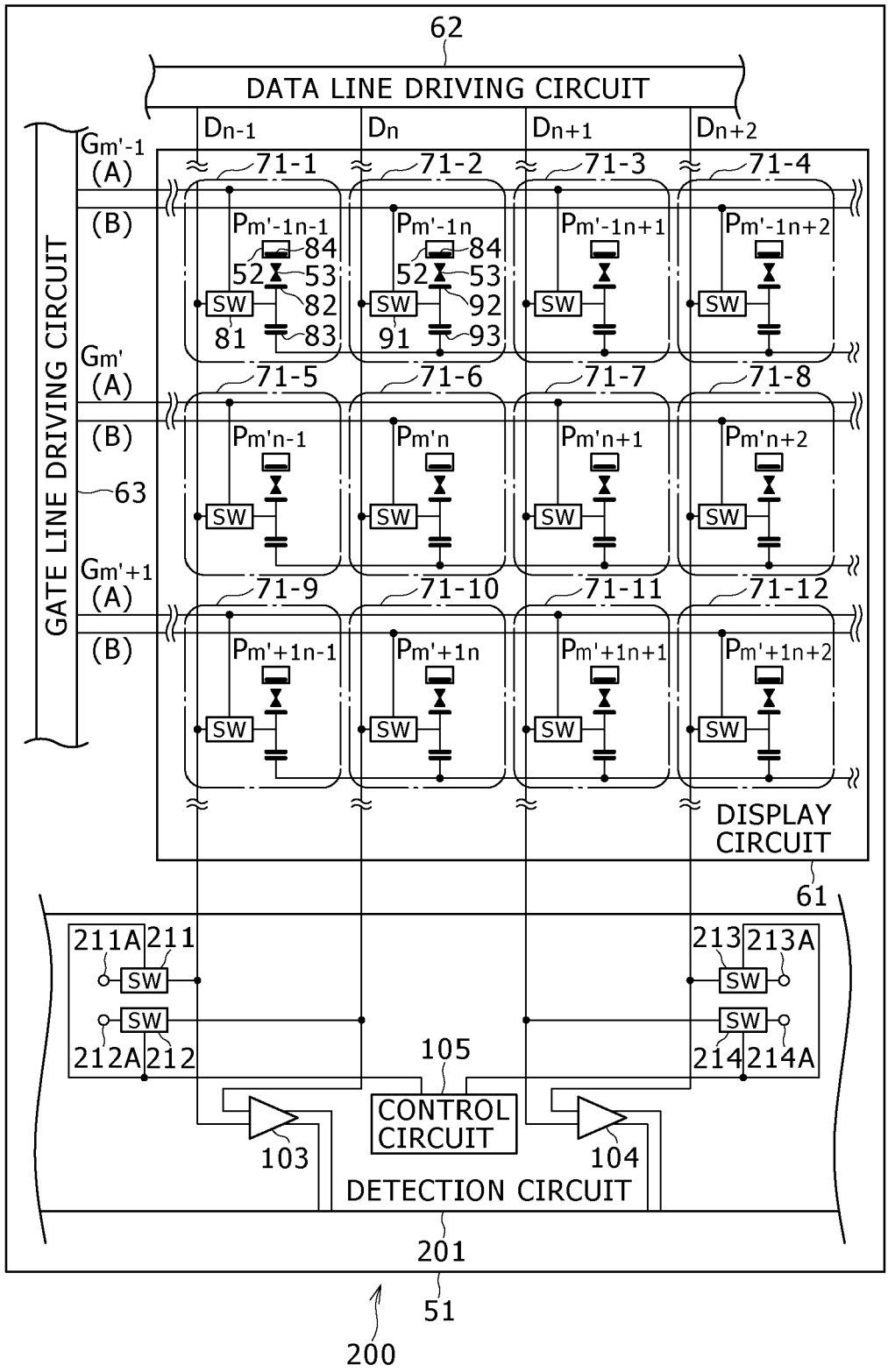
FIG. 11 is a schematic circuit diagram showing a structure of a liquid crystal display device according to a second embodiment of the present invention.

FIG. 11 is a schematic circuit diagram showing a structure of a liquid crystal display device according to a second embodiment of the present invention.

In the liquid crystal display device 200 shown in FIG. 11, the display circuit 61, the data line driving circuit 62, the gate line driving circuit 63, and a detection circuit 201 are disposed on the substrate 51. It is noted that the same portions as those shown in FIG. 3 are designated with the same reference numerals, respectively, and a repeated description thereof is omitted here for the sake of simplicity.

In the detection circuit 201, switches 211 to 214, and input terminals 211A to 214A are provided instead of providing the switches 101 and 102 shown in FIG. 3, and each of the potentials of the data lines D is set at the reference value Ve.

Each of the switches 211 to 214, for example, is constituted by the FET. Gates of the switches 211 to 214 are each connected to the control circuit 105. A drain of the switch 211 is connected to the input terminal 211A having a potential of the reference value Ve, and a source thereof is connected to the data line $D_{n-1}$. The switch 211 connects the input terminal 211A and the data line $D_{n-1}$ to each other in accordance with a control signal supplied from the control circuit 105, thereby setting the potential of the data line $D_{n-1}$ at the reference value Ve.

In addition, a drain of the switch 212 is connected to the input terminal 212A having a potential of the reference value Ve, and a source thereof is connected to the data line $D_n$. The switch 212 connects the input terminal 212A and the data line $D_n$ to each other in accordance with the control signal supplied from the control circuit 105, thereby setting the potential of the data line $D_n$ at the reference value Ve.

Moreover, a drain of the switch 213 is connected to the input terminal 213A having a potential of the reference value Ve, and a source thereof is connected to the data line $D_{n+2}$. The switch 213 connects the input terminal 213A and the data line $D_{n+2}$ to each other in accordance with a control signal supplied from the control circuit 105, thereby setting the potential of the data line $D_{n+2}$ at the reference value Ve.

Also, a drain of the switch 214 is connected to the input terminal 214A having a potential of the reference value Ve, and a source thereof is connected to the data line $D_{n+1}$. The switch 214 connects the input terminal 214A and the data line $D_{n+1}$ to each other in accordance with the control signal supplied from the control circuit 105, thereby setting the potential of the data line $D_{n+1}$ at the reference value Ve.

Figure 12:
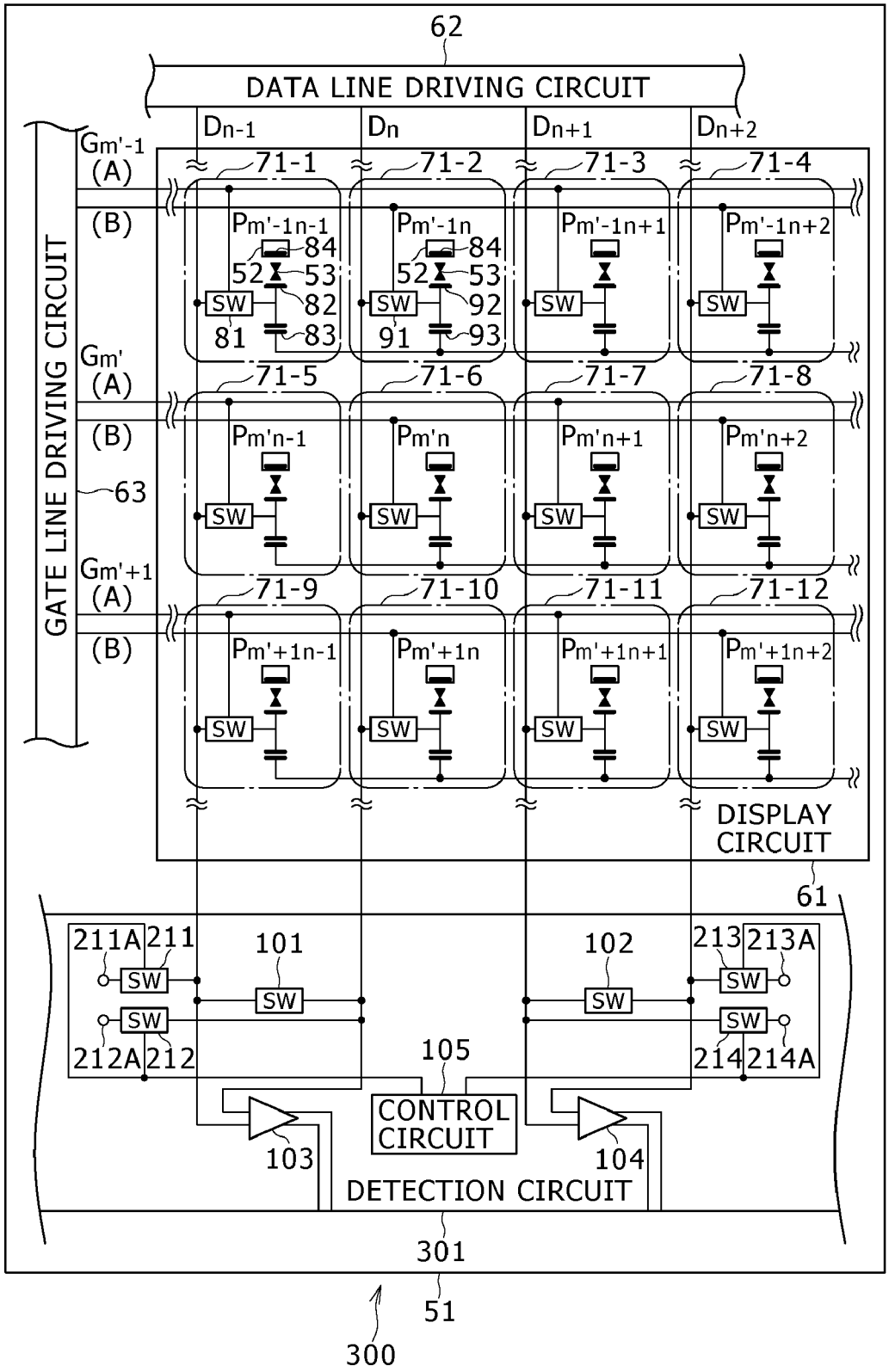
FIG. 12 is a schematic circuit diagram showing a structure of a liquid crystal display device according to a third embodiment of the present invention.

FIG. 12 is a schematic circuit diagram showing a structure of a liquid crystal display device according to a third embodiment of the present invention.

In the liquid crystal display device 300 shown in FIG. 12, the display circuit 61, the data line driving circuit 62, the gate line driving circuit 63, and a detection circuit 301 are disposed on the substrate 51. It is noted that the same portions as those shown in FIG. 3 or FIG. 11 are designated with the same reference numerals, respectively, and a repeated description thereof is omitted here for the sake of simplicity.

The detection circuit 301 is obtained by combining the detection circuit 64 shown in FIG. 3, and the detection circuit 201 shown in FIG. 11 with each other. That is to say, the detection circuit 301 is composed of the switches 101 and 102, the comparators 103 and 104, the control circuit 105, the switches 211 to 214, and the input terminals 211A to 214A.

In the detection circuit 301, the switches 211 and 212 are turned ON in accordance with a control signal supplied from the control circuit 105, so that each of the potentials of the data lines $D_{n-1}$ and $D_n$ becomes equal to the reference value Ve. At the same time, the switch 101 is turned ON, so that the potentials of the data lines $D_{n-1}$ and $D_n$ become equal to each other.

Likewise, the switches 213 and 214 are turned ON in accordance with a control signal supplied from the control circuit 105, so that each of the potentials of the data lines $D_{n+2}$ and $D_{n+1}$ becomes equal to the reference value Ve. At the same time, the switch 102 is turned ON, so that the potentials of the data lines $D_{n+2}$ and $D_{n+1}$ become equal to each other.

It is noted that although the user carries out the inspection for the fault by using the liquid crystal display device 50 in the above description, he/she can also carry out the inspection for the fault by using the substrate 51. In this case, the fault can be found out before the liquid crystal layer 53 is held between the substrate 51 and the counter substrate 52. Therefore, it is possible to reduce the assembly cost because the fault can be prevented from flowing out to the process for holding the liquid crystal layer 53 between the substrate 51 and the counter substrate 52. Also, it is possible to reduce the number of man-hour necessary for a manufacture test because the fault can be discovered before an image quality test which is performed based on an image actually displayed.

In addition, in this specification, the step for describing the program to be stored in the program recording medium includes processing which is executed in parallel or individually although not being necessarily executed in a time series manner as well as processing which is executed in a time series manner in the described order.

Moreover, the embodiments of the present invention are not limited to those described above, and various changes thereof can be made without departing from the gist of the present invention.

It should be understood by those skilled in the art that various modifications, combinations, sub-combinations and alterations may occur depending on design requirements and other factors insofar as they are within the scope of the appended claims or the equivalents thereof.

What is claimed is:

1. A driving circuit, comprising:

odd-numbered and even-numbered pixel cells arranged in a matrix of rows and columns;

odd-numbered data lines and even-numbered data lines alternately disposed in parallel with each other and the columns;

odd-number gate lines and even-numbered gate lines disposed in parallel with each other and at right angles to the data lines so as to be electrically insulated from said data lines, the gate lines disposed in pairs of one odd-numbered gate line and one even-numbered gate line;

a gate line driving circuit for driving the odd-numbered gate lines and the even-numbered gate lines independently of each other;

a data line driving circuit coupled to first ends of the data lines for driving the odd-number data lines and the even-numbered gate line independently of each other; and a detection circuit coupled to second ends of the data lines to receive signals from the data lines, the detection circuit including (1) inputting means for applying a signal having a predetermined potential to each of the odd-numbered gate lines and the even-numbered gate lines, the inputting means comprising a switch coupled between the odd-numbered and even-numbered data lines (2) a control circuit coupled to the inputting means to control same, and (3) comparing means for comparing potentials of each adjacent odd-numbered data line and even-numbered data line with each other, and outputting a comparison result, wherein, (a) each odd-numbered pixel cell is connected to an odd-numbered data line and an odd-numbered gate line, and each even-numbered pixel cell is connected to an even-numbered data line and an even-numbered gate line, the odd-numbered pixel cells of a given row being connected to the same odd-numbered gate line and respective odd-numbered data lines, the even-numbered pixel cells of a given row being connected to the same even-numbered gate line and respective data lines, the pixel cells of a given column being connected to the same data line;

(b) each of the pixel cells includes (i) accumulating means for accumulating therein charges based on a potential of a signal corresponding to pixel data input through corresponding one of the data lines connected thereto, and (ii) connecting means for connecting the corresponding one of the data lines connected thereto and the accumulating section to each other based on a potential of the corresponding one of the data lines connected thereto; and (c) said data lines, said gate lines, said pixel cells, said gate line driving circuit, said data line driving circuit, said inputting means, and said comparing means are disposed either on one semiconductor substrate or on one insulating substrate.

2. The driving circuit according to claim 1, wherein each inputting means connects an odd-numbered data line and an adjacent even-numbered data line to each other in accordance with the control signal, thereby causing the potentials of the adjacent odd-numbered data line and even-numbered data line to be at an average value of both.

3. The driver according to claim 1, wherein said inputting means includes:

odd-numbered inputting means for applying the signal having the predetermined potential to each of the odd-numbered data lines in accordance with the control signal; and even-numbered inputting means for independently applying the signal having the predetermined potential to each of the even-numbered data lines in accordance with the control signal.

4. A method of driving the driver circuit of claim 1, said method comprising the steps of:

driving the odd-numbered gate lines and the even-numbered gate lines using respective first and second potentials;

accumulating charges in each of the odd-numbered pixel cells based on the first potential of each of the odd-numbered data lines, and accumulating charges in each of the even-numbered pixel cells based on the second potential of each of the even-numbered data lines in accordance with the drive;

stopping the drive for the odd-numbered gate lines and the even-numbered gate lines;

stopping the accumulation of the charges in each of the odd-numbered pixel cells and the even-numbered pixel cells in accordance with a stop of the drive to hold the charges in each of the odd-numbered pixel cells and the even-numbered pixel cells;

setting a potential of each of the odd-numbered data lines and the even-numbered data lines to a predetermined potential;

putting each of the odd-numbered data lines and the even-numbered data lines into a high impedance state;

driving one of the odd-numbered gate lines and the even-numbered gate line adjacent thereto as a drive object;

outputting the charges accumulated in the odd-numbered pixel cells or the even-numbered pixel cells connected of the drive object to the odd-numbered data line or the even-numbered data line in accordance with the drive;

comparing potentials of the drive object odd-numbered data line and even-numbered data line with each other; and executing one side processing as processing.

5. The method according to claim 4, wherein the first potential is different in polarity from the second potential with respect to the predetermined potential.

6. The method according to claim 5, further comprising the step of executing one changing processing as processing for changing the potential of each of the odd-numbered data lines from the first potential to the second potential, and changing the potential of each of the even-numbered data lines from the second potential to the first potential in the one side processing.

7. The method according to claim 4, further comprising the step of executing the other processing as processing for changing said drive object from ones of the odd-numbered gate lines and the even-numbered gate lines adjacent thereto to the others of the odd-numbered gate lines and the even-numbered gate lines adjacent thereto in the one processing.

8. The method according to claim 7, wherein the first potential and the second potential are different in polarity from each other with respect to the predetermined potential; and wherein said driving method further includes the step of executing the other changing processing as processing for changing the potential of each of the odd-numbered data lines from the first potential to the second potential, and changing the potential of each of the even-numbered data lines from the second potential to the first potential.

9. The method according to claim 4, further comprising the step of executing both processing as processing for changing said drive object from ones of the odd-numbered gate lines and the even-numbered gate lines adjacent thereto to both of the odd-numbered gate lines and the even-numbered gate lines adjacent thereto in said one processing.

10. The method according to claim 9, wherein the first potential and the second potential are different in polarity from each other with respect to the predetermined potential; and wherein said driving method further includes the step of executing both changing processing as processing for changing the potential of each of the odd-numbered data lines from the first potential to the second potential, and changing the potential of each of the even-numbered data lines from the second potential to the first potential in the both processing.

11. A liquid crystal display device, comprising:

a first substrate as a semiconductor substrate or an insulating substrate;

a second substrate, as a semiconductor substrate or an insulating substrate having a common electrode, disposed so as to face said first substrate; and a liquid crystal layer held between said first substrate and said second substrate;

wherein, said first substrate includes:

(a) odd-numbered and even-numbered pixel cells arranged in a matrix of rows and columns;

(b) odd-numbered data lines and even-numbered data lines alternately disposed in parallel with each other and the columns;

(c) odd-number gate lines and even-numbered gate lines disposed in parallel with each other and at right angles to said data lines so as to be electrically insulated from said data lines, the gate lines disposed in pairs of one odd-numbered gate line and one even-numbered gate line;

(d) a gate line driving circuit for driving the odd-numbered gate lines and the even-numbered gate lines independently of each other;

(e) a data line driving circuit coupled to first ends of the data lines for driving the odd-number data lines and the even-numbered gate line independently of each other; and (f) a detection circuit coupled to second ends of the data lines to receive signals from the data lines, the detection circuit including (1) inputting means for applying a signal having a predetermined potential to each of the odd-numbered gate lines and the even-numbered gate lines, the inputting means comprising a switch coupled between the odd-numbered and even-numbered data lines, (2) a control circuit coupled to the inputting means to control same, and (3) comparing means for comparing potentials of each adjacent odd-numbered data line and even-numbered data line with each other, and outputting a comparison result, and wherein, (i) each odd-numbered pixel cell is connected to an odd-numbered data line and an odd-numbered gate line, and each even-numbered pixel cell is connected to an even-numbered data line and an even-numbered gate line, the odd-numbered pixel cells of a given row being connected to the same odd-numbered gate line and respective odd-numbered data lines, the even-numbered pixel cells of a given row being connected to the same even-numbered gate line and respective data lines, the pixel cells of a given column being connected to the same data line;

(i) each of the pixel cells includes (1) accumulating means for accumulating therein charges based on a potential of a signal corresponding to pixel data inputted through corresponding one of the data lines connected thereto, and (2) connecting means for connecting the corresponding one of the data lines connected thereto and the accumulating section to each other based on a potential of corresponding one of the data lines connected thereto; and (iii) said data lines, said gate lines, said pixel cells, said gate line driving circuit, said data line driving circuit, said inputting means, and said comparing means are disposed either on one semiconductor substrate or on one insulating substrate.

12. The driving circuit of claim 1, wherein the inputting means comprises a field effect transistor.

13. The driving circuit of claim 11, wherein the inputting means comprises a field effect transistor.

14. The method of claim 4, wherein, wherein the inputting means comprises a switch coupled between the odd-numbered and even-numbered data lines.

15. The method of claim 14, wherein, the inputting means comprises a field effect transistor.

* * * * *